US011369181B2

(12) United States Patent
Kuga

(10) Patent No.: US 11,369,181 B2
(45) Date of Patent: Jun. 28, 2022

(54) COSMETIC MATERIAL FEEDING CONTAINER

(71) Applicant: TOKIWA CORPORATION, Nakatsugawa (JP)

(72) Inventor: Wataru Kuga, Kawaguchi (JP)

( * ) Notice: Subject to any disclaimer, the term of this patent is extended or adjusted under 35 U.S.C. 154(b) by 0 days.

(21) Appl. No.: 17/148,563

(22) Filed: Jan. 14, 2021

(65) Prior Publication Data

US 2021/0212440 A1 Jul. 15, 2021

(30) Foreign Application Priority Data

Jan. 15, 2020 (JP) ..... JP2020-004526
Nov. 6, 2020 (JP) ..... JP2020-185843

(51) Int. Cl.

*B43K 5/06* (2006.01)
*A45D 40/04* (2006.01)
*A45D 40/06* (2006.01)
*A45D 40/00* (2006.01)
*A45D 40/20* (2006.01)

(52) U.S. Cl.

CPC ..... *A45D 40/04* (2013.01); *A45D 40/06* (2013.01); *A45D 40/065* (2013.01); *A45D 2040/0031* (2013.01); *A45D 2040/208* (2013.01)

(58) Field of Classification Search

CPC ..... A45D 40/04; A45D 40/06; A45D 40/065; A45D 2040/208

See application file for complete search history.

(56) References Cited

U.S. PATENT DOCUMENTS 7,455,467 B2 * 11/2008 Sasaki ..... A45D 40/04 401/68
7,736,079 B2 * 6/2010 Tani ..... B43K 21/08 401/69
9,101,194 B2 * 8/2015 Ishida ..... A45D 40/205
10,299,564 B2 * 5/2019 Ishida ..... A45D 40/04

FOREIGN PATENT DOCUMENTS

JP 2010-178828 8/2010

* cited by examiner

*Primary Examiner* — Jennifer C Chiang
(74) *Attorney, Agent, or Firm* — Soei Patent & Law Firm

(57) ABSTRACT

A cosmetic material feeding container includes a cylindrical tube that accommodates a cosmetic material, a leading cylinder to removably accommodate the tube, a container body that is detachably coupled with the leading cylinder, a cylindrical female screw member located inside the container body that is rotationally fixed with the container body, a pusher bar located inside the leading cylinder to push the cosmetic material in an axial direction to an outside of the tube when the pusher bar is rotated to screw into the female screw member, and a rotation stopper member located inside the leading cylinder to rotationally fix the pusher bar relative to the leading cylinder in the circumferential direction. The tube may be replaced when the leading cylinder is detached from the container body.

6 Claims, 28 Drawing Sheets

COSMETIC MATERIAL FEEDING CONTAINER

CROSS-REFERENCE TO RELATED APPLICATIONS

This application claims the benefit of priority from Japanese Patent Application No. 2020-004526, filed on Jan. 15, 2020, and from Japanese Patent Application No. 2020-185843, filed on Nov. 6, 2020, the entire contents of which are incorporated herein by reference.

BACKGROUND

In the related art, various cosmetic material feeding containers that feed cosmetic materials, are known. Japanese Patent Application No. 2010-178828 discloses a cartridge-type cosmetic material accommodation container. A container body of the cartridge-type cosmetic material accommodation container includes an outer cylinder, a body cylinder provided inside the outer cylinder, and an inner tool provided in an opening portion of the body cylinder. The container body further includes a cartridge body, and the cartridge body includes an inner cylinder. The body cylinder has a bottomed stopper portion with which a lower end portion of the inner cylinder of the cartridge body comes into contact. In addition to the above-described inner cylinder, the cartridge body includes a filling case filled with a cosmetic material, an operation claw body, an extruder piece, and a slider. In the cartridge body, the body cylinder and the inner tool of the container body are replaceable.

SUMMARY

In the above-described cartridge-type cosmetic material accommodation container, when a cosmetic material inside the filling case is completely used, the cartridge body having the filling case is detached, and a new cartridge body is attached. In this manner, the container body is not discarded. Therefore, the cartridge-type cosmetic material accommodation container can be used as an economical and environmentally-friendly container.

However, the above-described cartridge body includes the inner cylinder, the filling case, the operation claw body, the extruder piece, and the slider. Therefore, after the cosmetic material inside the filling case is no longer present, the filling case is discarded together with the cartridge body including a plurality of components. Accordingly, the plurality of components are discarded under such circumstances. It is therefore desirable to further reduce the number of components to be discarded after the cosmetic material is used.

An object of the present disclosure is to provide a cosmetic material feeding container having a reduced number of components to be discarded.

According to an aspect of the present disclosure, there is provided a cosmetic material feeding container including a cylindrical tube that accommodates a cosmetic material, a leading cylinder that internally accommodates the tube to be attachable and detachable, and having an opening through which the cosmetic material is exposed, a container body that engages with the leading cylinder to be attachable and detachable, a cylindrical female screw member synchronously rotatable (e.g., rotationally fixed) with the container body inside the container body, and having a female screw (e.g., a female screw thread) on an inner surface, a pusher bar having a male screw (e.g., a male screw thread) screwed into the female screw of the female screw member, and pushing the cosmetic material accommodated in the tube to an outside of the tube, and a rotation stopper member that restricts rotation of the pusher bar provided inside the leading cylinder in a circumferential direction. The tube is replaceable (exchangeable) in a state where the leading cylinder is detached from the container body.

In the cosmetic material feeding container, the tube that accommodates the cosmetic material is provided inside the leading cylinder, and the leading cylinder engages with the container body to be attachable to and detachable from the container body. The cylindrical female screw member is provided inside the container body, and the female screw member forms the female screw into which the male screw of the pusher bar is screwed. The pusher bar is provided on the side opposite to the opening of the leading cylinder when viewed from the cosmetic material accommodated inside the tube. The pusher bar is restricted from rotating in the circumferential direction by the rotation stopper member, and moves forwardly by a screwing action between the male screw and the female screw which are described above. In this case, the cosmetic material accommodated in the tube is pushed by the pusher bar moving forwardly. Accordingly, the cosmetic material may be exposed from the opening of the leading cylinder so as to apply the cosmetic material to a surface. The leading cylinder is attachable to and detachable from the container body. The tube is replaceable in a state where the leading cylinder is detached from the container body. Therefore, the tube alone may be replaced when the leading cylinder is detached from the container body, so as to reduce the number of components to be discarded. Accordingly, it is possible to reduce the number of components to be discarded after the cosmetic material is used.

The rotation stopper member may have a projection on an outer peripheral surface. The tube may have a groove by which the projection is caught from an end portion of the tube on the rotation stopper member side. In this case, the projection of the rotation stopper member is caught in the groove of the tube, so that the tube may be rotationally fixed with the rotation stopper member. Therefore, in a state where the leading cylinder is detached from the container body, the tube may be prevented from being unintentionally detached from the rotation stopper member and the pusher bar.

The pusher bar may move forwardly as the container body rotates in one direction (e.g., a first direction). A ratchet member provided inside the container body, and restricting the rotation of the container body in a direction (e.g., a second direction) opposite to the one direction may be provided. The ratchet member may have a second ratchet tooth that engages with a first ratchet tooth formed in the female screw member. In this case, the pusher bar moves forwardly as the container body rotates in the one direction (e.g., the first direction), and the rotation of the container body in the direction (e.g., the second direction) opposite to the one direction is restricted by the ratchet member. Therefore, the rotation of the container body in the opposite direction and unintended rearward movement of the cosmetic material and the pusher bar may be prevented.

The rotation stopper member may engage with the ratchet member to be synchronously rotatable (e.g., rotationally fixed therewith), and may have a cylindrical shape. When the leading cylinder is detached from the container body, the rotation stopper member is movable in the axial direction to disengage from the ratchet member, so as to be rotatable in the circumferential direction with respect to the ratchet member. In this case, when the leading cylinder is detached from the container body, the rotation stopper member moves forwardly, is disengaged from the ratchet member, and is rotatable with respect to the ratchet member. Therefore, the pusher bar is also rotated by the rotation of the rotation stopper member with respect to the ratchet member. In this manner, the pusher bar can move rearwardly in a state where the leading cylinder is detached from the container body.

The cosmetic material feeding container may further include a tail plug located on a side opposite to the leading cylinder in the container body. The tail plug may seal an opening (e.g., an open end of the container body) located on the side opposite to the leading cylinder in the container body. In this case, airtightness of the cosmetic material feeding container can be ensured by the tail plug sealing the opening of the container body.

The tube may be engageable with the pusher bar along an axial direction of the tube. The tube may be replaceable by being detached from the pusher bar. A spring member for biasing the pusher bar so that the pusher bar moves rearwardly (e.g., toward a rear end of the pusher bar) when the tube is detached from the pusher bar may be provided. In this case, when the tube engages with the pusher bar, a forward movement state of the pusher bar is maintained by the engagement. Then, when the tube is detached from the pusher bar, the tube disengages from the pusher bar. Accordingly, the pusher bar automatically moves rearwardly due to a biasing force of the spring member. Therefore, the pusher bar can automatically return to an initial position when the tube is replaced (exchanged). Accordingly, a new tube can be easily attached, and usability of the cosmetic material feeding container can be satisfactorily improved.

According to examples of the present disclosure, the number of components to be discarded when replenishing the cosmetic material, may be reduced.

DETAILED DESCRIPTION

Hereinafter, examples of a cosmetic material feeding container will be described with reference to the drawings. In the following description, with reference to the drawings, the same reference numbers are assigned to the same components or to similar components having the same function, and overlapping description is omitted.

Figure 1:
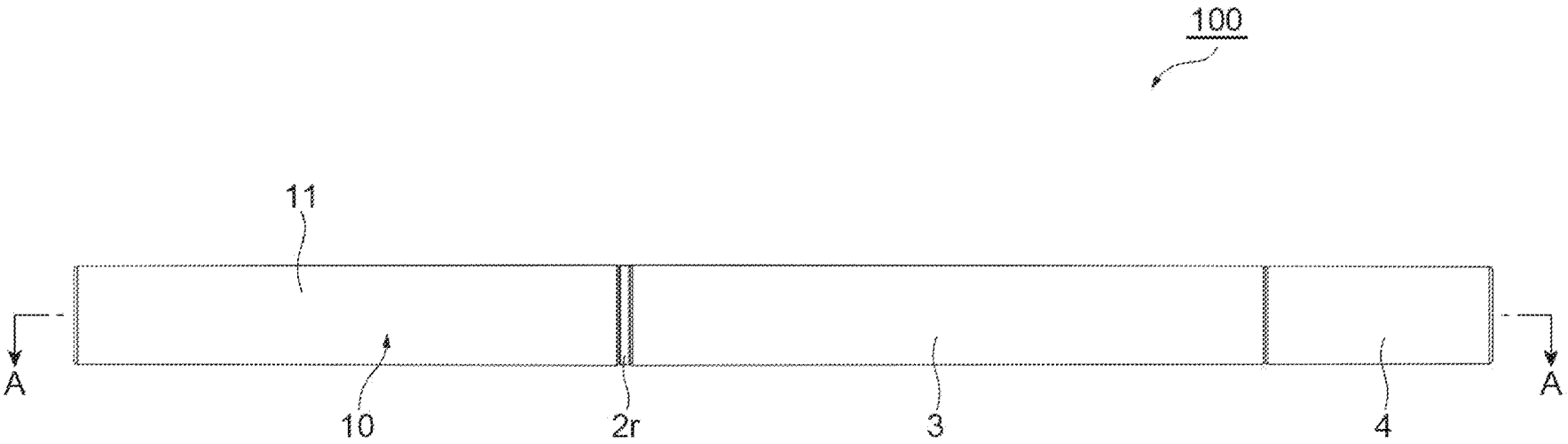
FIG. 1 is a side view illustrating a cosmetic material feeding container according to an example of the present disclosure.
Figure 2:
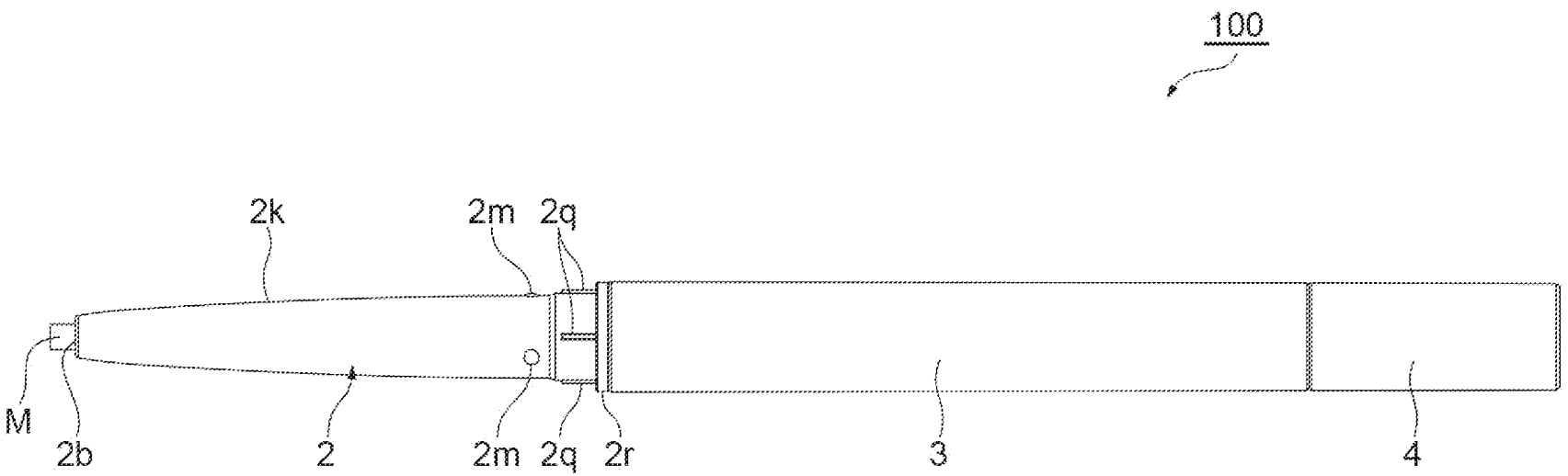
FIG. 2 is a side view illustrating a state where a cap is detached from the cosmetic material feeding container in FIG. 1.
Figure 3:
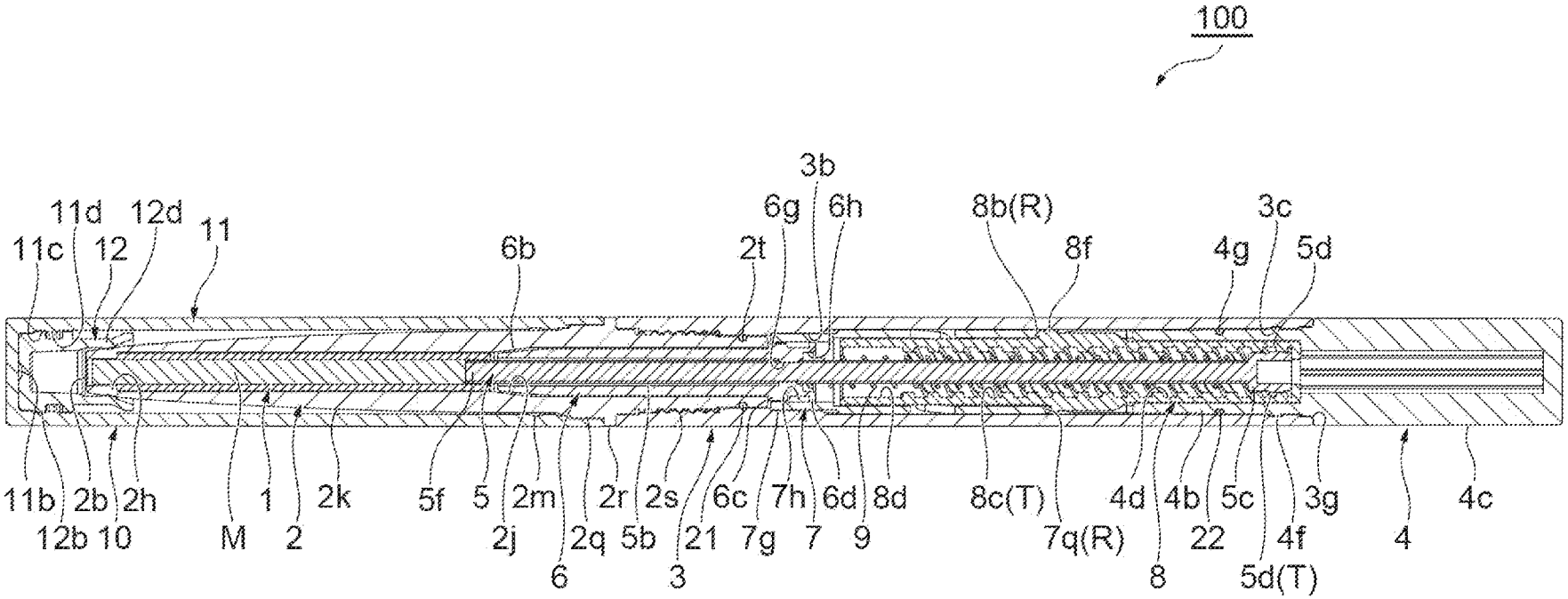
FIG. 3 is a cross-sectional view taken along line A-A of the cosmetic material feeding container of FIG. 1.

FIG. 1 is a side view illustrating an example cosmetic material feeding container according to an example. FIG. 2 is a side view of the cosmetic material feeding container of FIG. 1, illustrating a state where a cap is detached from the cosmetic material feeding container. FIG. 3 is a cross-sectional view of the cosmetic material feeding container illustrated in FIG. 1, taken along line A-A. As illustrated in FIGS. 1 to 3, for example, the example cosmetic material feeding container 100 is a pencil that feeds (pushes out) a cosmetic material M accommodated inside a tube 1 by an operation of a user.

For example, the cosmetic material M may be a lip liner, a lipstick, a lip gloss, an eyebrow pencil, an eyeliner, a beauty stick, or a concealer. The cosmetic material M may be a very soft bar-shaped material (for example, such as semi-solid, soft-solid, soft, jelly-like, and mousse-like materials, or paste products containing these materials). Furthermore, the cosmetic material M has a bar-shaped thin material having an outer diameter of 1.5 mm or less, a bar-shaped general material having an outer diameter of 1.5 mm to 3.0 mm, or a bar-shaped thick material having an outer diameter of 4.0 mm or more.

The cosmetic material feeding container 100 includes a leading cylinder 2 that internally includes the tube 1 for accommodating the cosmetic material M, and a cylindrical container body 3 connected to a rear end portion of the leading cylinder 2 and engaging with the leading cylinder 2, and a tail plug 4 which is an operation cylinder connected to a rear end portion of the container body 3 and engaging with the container body 3 to be relatively rotatable. The cosmetic material feeding container 100 further includes a cap 10 attached to the leading cylinder 2, and may be used as follows. The cap 10 is detached, and when the container body 3 is rotated relative to the tail plug 4 in a first direction, the cosmetic material M is pushed out from the leading cylinder 2.

The cap 10 includes a bottomed cylindrical outer cap (e.g., a closed-ended cylindrical outer cap) 11 and a stepped cylindrical inner cap 12 held by a bottom portion 11*b* of the outer cap 11. An inner surface of the outer cap 11 has an annular recess portion 11*c* and an annular projection portion 11*d*. The outer cap 11 is a portion into which the leading cylinder 2 is inserted.

The inner cap 12 has an annular projection portion 12*b* on an outer peripheral surface, and the inner cap 12 is fixed to the outer cap 11 in such a manner that the annular projection portion 12*b* riding across the annular projection portion 11*d* is fitted into the annular recess portion 11*c*. The inner cap 12 is provided to ensure airtightness of the cosmetic material M located inside the leading cylinder 2 to which the cap 10 is attached. The inner cap 12 has a cylindrical insertion portion 12*d* into which the leading cylinder 2 is inserted, and the inner diameter of the insertion portion 12*d* is approximately the same as the outer diameter of a tip portion of the leading cylinder 2.

In the present disclosure, the term "axis" refers to a longitudinal axis of a substantially cylindrical body, such as a center line of the cosmetic material feeding container extending along a longitudinal direction of the cosmetic material feeding container. The term "axial direction" refers to the longitudinal direction of the cosmetic material feeding container, such as a direction along the axis. The term "forward" indicates a direction from the container body 3 toward the leading cylinder 2 in the axial direction, and the term "rearward" indicates a direction from the container body 3 toward the tail plug 4 in the axial direction. Accordingly, directional terms such as "forwardly", "front", "rearwardly", "rear", "behind" and the like, may be understood with reference to the "forward" and "rearward" directions. The term "radial direction" may indicate a direction orthogonal to the axis, and the term "circumferential direction" may indicate a direction along a ring formed around the axis. In the present disclosure, a feeding direction of the cosmetic material M will be defined as forward (forward movement direction), and a direction opposite thereto will be defined as rearward (rearward movement direction).

In the example cosmetic material feeding container 100, only the tube 1 is replaced in order to replenish the cosmetic material feeding container 100 with a new cosmetic material. A pusher bar 5 that pushes out the cosmetic material M is inserted into the tube 1. The pusher bar 5 is disposed to extend in the axial direction inside a cylindrical rotation stopper member 6 located inside the leading cylinder 2, a cylindrical ratchet member 7 located inside the container body 3, and a cylindrical female screw member 8 located inside the tail plug 4.

The pusher bar 5 is biased rearwardly by a spring member 9 disposed inside the ratchet member 7. The ratchet member 7 and the female screw member 8 form a ratchet mechanism R which is described further below. In some examples, the spring member 9 may be a compression coil spring. The ratchet mechanism R allows the container body 3 to rotate relative to the tail plug 4 in only the first direction (for example, in a clockwise direction), and restricts the relative rotation of the container body 3 in a second direction opposite to the first direction (for example, in a counter-clockwise direction).

Figure 4A:
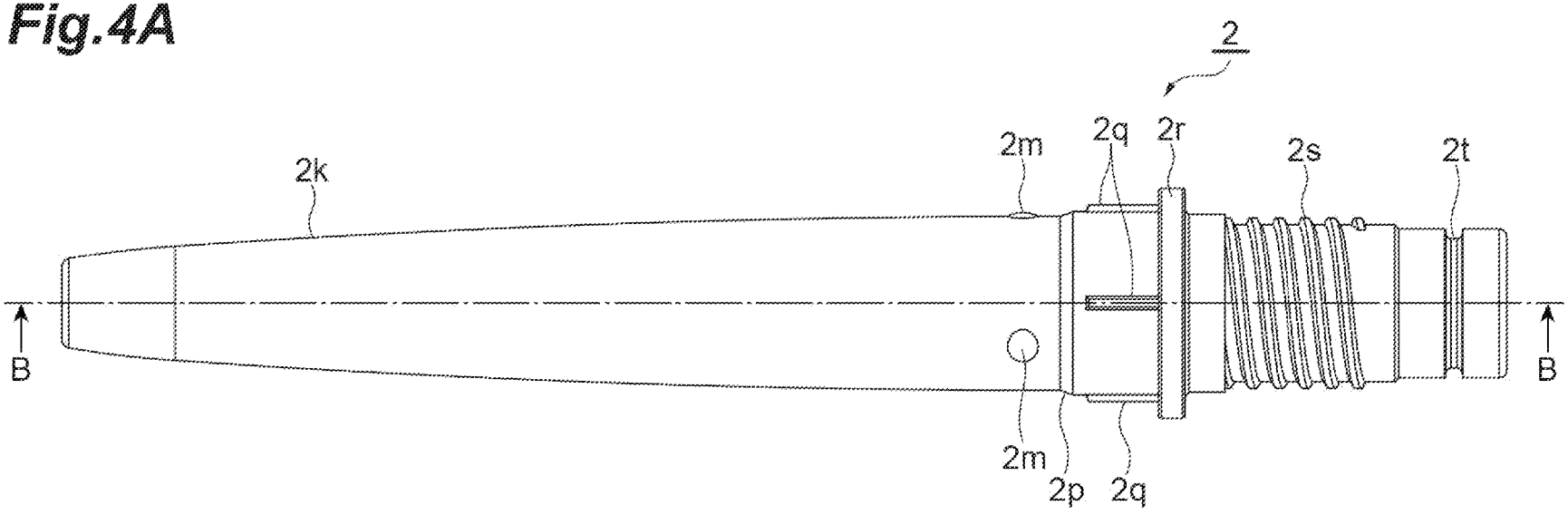
FIG. 4A is a side view illustrating a leading cylinder of the cosmetic material feeding container of FIG. 1.
Figure 4B:
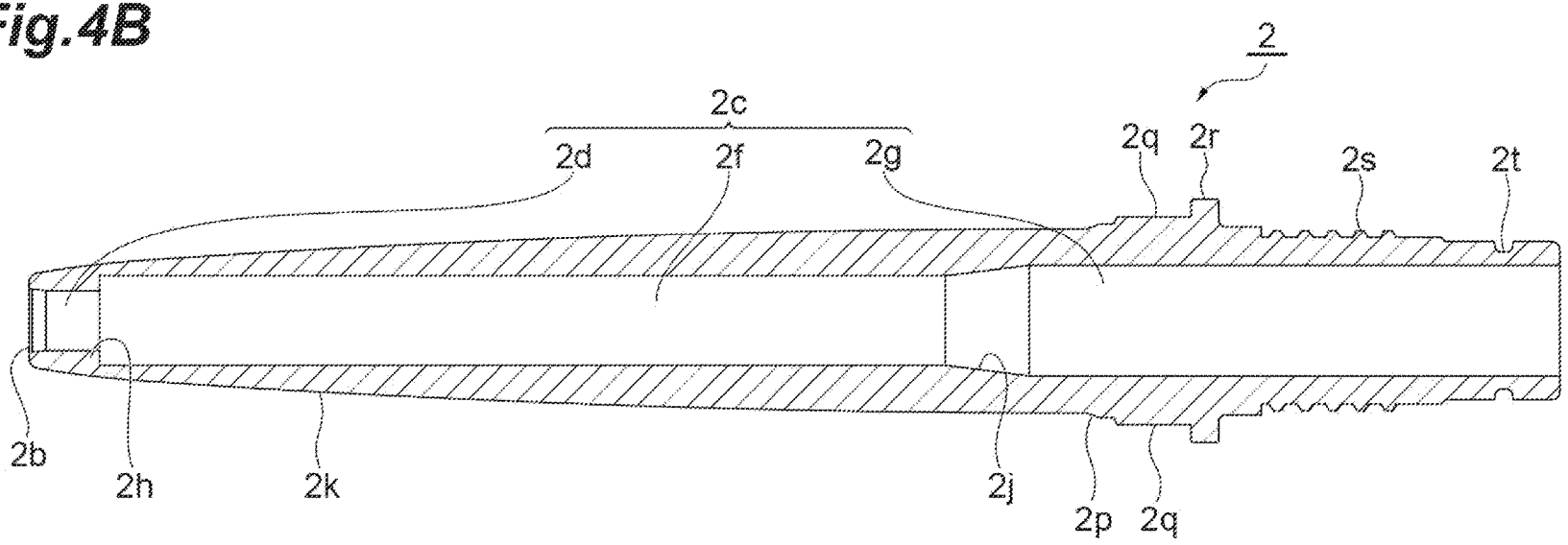
FIG. 4B is a cross-sectional view taken along line B-B of the leading cylinder of FIG. 4A.

FIG. 4A is a side view illustrating the leading cylinder 2. FIG. 4B is a cross-sectional view of the leading cylinder 2 illustrated in FIG. 4B, taken along line B-B. As illustrated in FIGS. 4A and 4B, the leading cylinder 2 has an opening 2*b* through which the cosmetic material M accommodated in the tube 1 may be exposed. An accommodation region 2*c* for accommodating the cosmetic material M, the tube 1, and the rotation stopper member 6 is provided inside the leading cylinder 2, and the tube 1 is disposed on a front side of the pusher bar 5 in the accommodation region 2*c*.

In some examples, the accommodation region 2*c* of the leading cylinder 2 includes a front accommodation region 2*d*, a central accommodation region 2*f*, and a rear accommodation region 2*g*. The cosmetic material M protruding from the tube 1 is accommodated in the front accommodation region 2*d*, the tube 1 is accommodated in the central accommodation region 2*f*, and the rotation stopper member 6 is accommodated in the rear accommodation region 2*g*. The inner diameter of the front accommodation region 2*d* is smaller than the inner diameter of the central accommodation region 2*f*. A step portion 2*h* protruding inwardly in the radial direction from the central accommodation region 2*f* toward the front accommodation region 2*d* is formed between the front accommodation region 2*d* and the central accommodation region 2*f*. An end portion of the tube 1 in the axial direction comes into contact with the step portion 2*h*.

The inner diameter of the central accommodation region 2*f* is smaller than the inner diameter of the rear accommodation region 2*g*. A front side of the rear accommodation region 2*g* has a tapered surface 2*j* whose diameter decreases toward the central accommodation region 2*f*. The tapered surface 2*j* is a portion where an end portion of the rotation stopper member 6 in the axial direction enters, and the forward movement of the rotation stopper member 6 is further restricted by the tapered surface 2*j*.

An inclined surface 2*k* inclined to be tapered forward is formed on a front side of an outer periphery of the leading cylinder 2. A plurality of projections 2*m*, a tapered surface 2*p*, and a plurality of ridges 2*q* for attaching the cap 10 are formed on a rear side of the inclined surface 2*k*. The plurality of projections 2*m*, the tapered surface 2*p*, and the plurality of ridges 2*q* are aligned in this order from the front to the rear. The plurality of projections 2*m* and the plurality of ridges 2*q* are aligned along the circumferential direction of the leading cylinder 2.

The leading cylinder 2 has a flange portion 2*r* on a rear side of the ridge 2*q*, the cap 10 contacts a front surface of the flange portion 2*r*, and the container body 3 contacts a rear surface of the flange portion 2*r*. The leading cylinder 2 has a male screw 2*s* and an annular recess portion 2*t* behind the flange portion 2*r*. The male screw 2*s* is provided on a front side of the annular recess portion 2*t*. The male screw 2*s* is a portion to which the container body 3 is screwed, so as to attach the leading cylinder 2 to the container body 3 by screwing the leading cylinder 2 to the container body 3. The annular recess portion 2*t* is a portion into which the O-ring 21 (cf. FIG. 3) may be inserted. The leading cylinder 2 is attached to the container body 3 in a state where an O-ring 21 is inserted into the annular recess portion 2*t*.

Figure 5A:
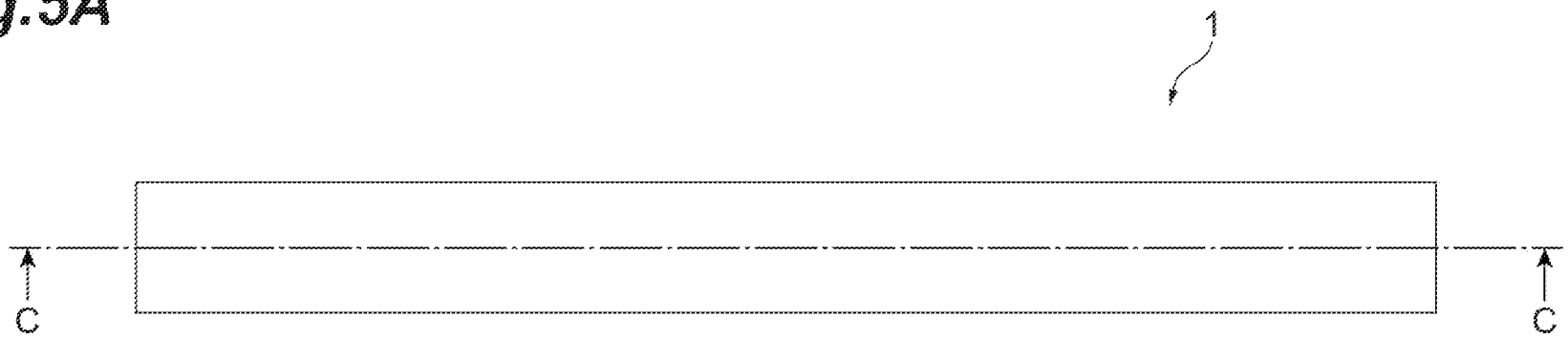
FIG. 5A is a side view illustrating a tube of the cosmetic material feeding container of FIG. 1.
Figure 5B:
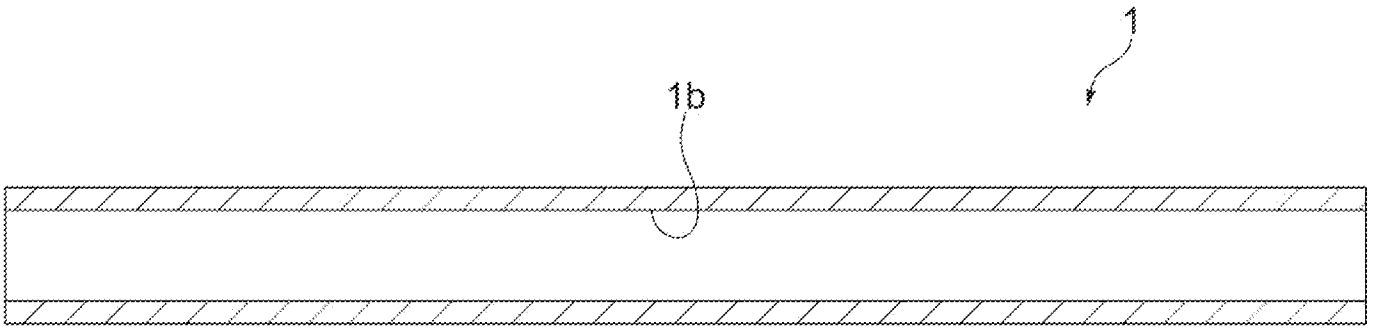
FIG. 5B is a cross-sectional view taken along line C-C of the tube of FIG. 5A.

FIG. 5A is a side view illustrating the tube 1 in which the cosmetic material M is accommodated. FIG. 5B is a cross-sectional view of the tube 1 illustrated in FIG. 5A, taken along line C-C. As illustrated in FIGS. 5A and 5B, the tube 1 has a cylindrical shape. The tube 1 can accommodate the cosmetic material M. As a material of the tube 1, for example, polypropylene (PP) may be used.

The cosmetic material M fills the inside of the tube 1 in advance, and the filling cosmetic material M is pushed out by the pusher bar 5 at the rear end of the cosmetic material M. In this manner, the cosmetic material M protruding from the leading cylinder 2 is applied. For example, an inner surface 1*b* of the tube 1 may form a smooth surface. Accordingly, the cosmetic material M can be smoothly pushed out from the tube 1 by the pusher bar 5.

Figure 6A:
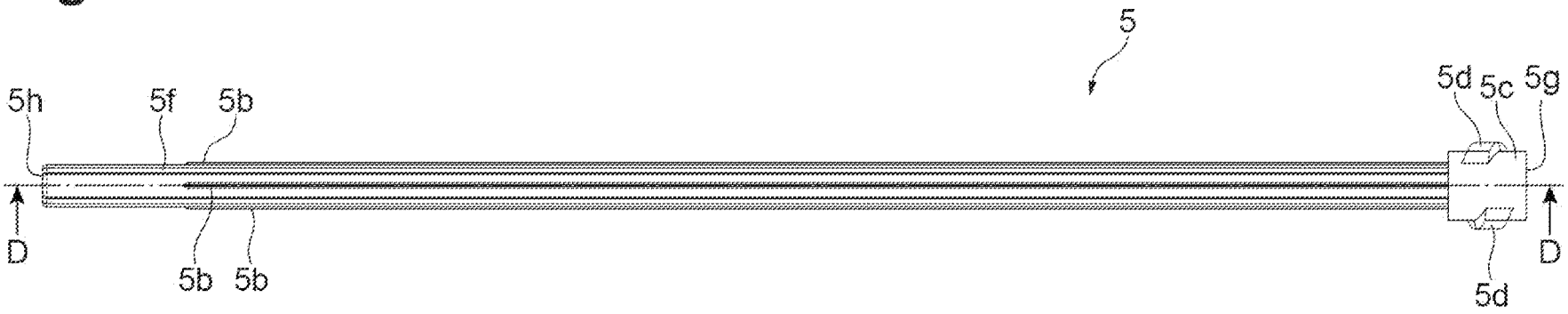
FIG. 6A is a side view illustrating a pusher bar of the cosmetic material feeding container of FIG. 1.
Figure 6B:
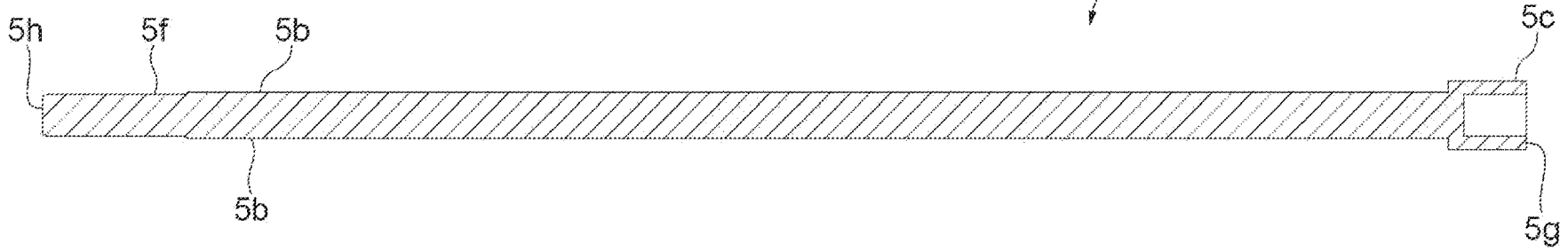
FIG. 6B is a cross-sectional view taken along line D-D of the pusher bar of FIG. 6A.
Figure 7:
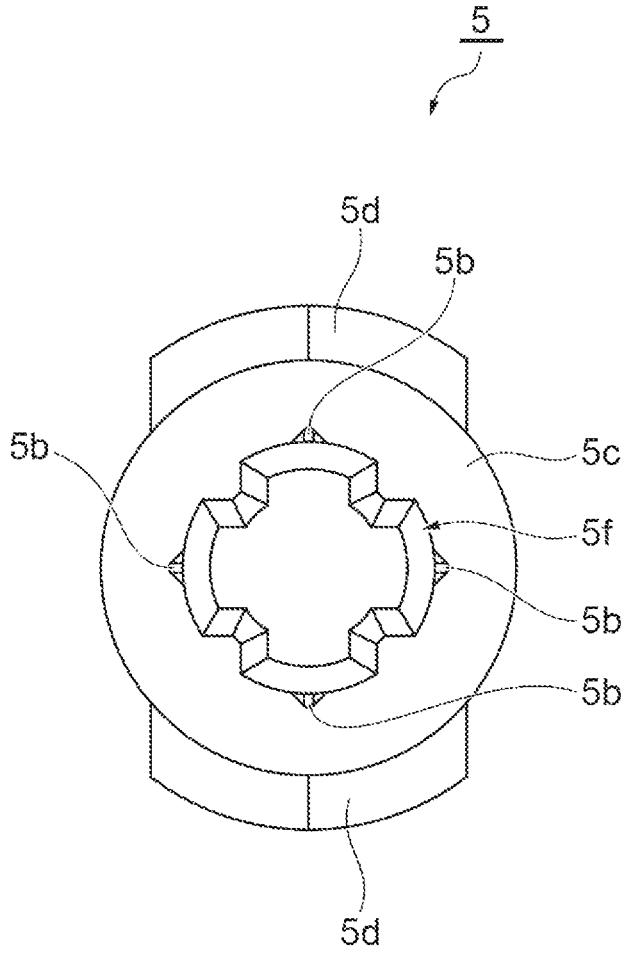
FIG. 7 is a front view of the pusher bars of FIG. 6A.

FIG. 6A is a side view illustrating the pusher bar 5. FIG. 6B is a cross-sectional view taken along line D-D of the pusher bar 5 in FIG. 6A. FIG. 7 is a front view of the pusher bar 5 (e.g., when the pusher bar 5 is viewed from the front side). As illustrated in FIGS. 6A, 6B, and 7, the pusher bar 5 has a bar-shaped portion 5*f* that pushes out the cosmetic material M accommodated inside the tube 1 in the forward direction, and a greatest diameter of the outer diameter of the bar-shaped portion 5*f* is approximately the same as the inner diameter of the tube 1. A ridge 5*b* extending in the axial direction is formed on an outer peripheral surface of the bar-shaped portion 5*f*. The pusher bar 5 has an enlarged diameter portion 5*c* located on a rear side (e.g., rear end) 5*g* of the bar-shaped portion 5*f* and a male screw (e.g., a male screw thread) 5*d* formed on an outer periphery of the enlarged diameter portion 5*c*.

A shape of the bar-shaped portion 5*f* of the pusher bar 5 when viewed from the front side (e.g., front end) 5*h* is a cross shape extending vertically and horizontally. For example, the enlarged diameter portion 5*c* has a bottomed cylindrical shape (e.g., a closed-ended cylindrical shape). When viewed from the front side, male screws 5*d* are respectively formed on a first side and a second side opposite the first side (upper side and lower side in FIG. 7) of the enlarged diameter portion 5*c* in the radial direction. The pusher bar 5 includes a plurality of ridges 5*b*, and the plurality of ridges 5*b* are disposed to be aligned along the circumferential direction of the pusher bar 5.

The bar-shaped portion 5*f* engages with the rotation stopper member 6 in the circumferential direction. In this manner, the pusher bar 5 can move in the axial direction with respect to the rotation stopper member 6, and is rotationally fixed relative to the rotation stopper member 6, so that the pusher bar 5 cannot move in the circumferential direction relative to the rotation stopper member 6. The enlarged diameter portion 5*c* is a portion having a diameter that is greater than that of the bar-shaped portion 5*f*, and forms a rear end of the pusher bar 5. A front surface of the enlarged diameter portion 5*c* corresponds to a portion that supports the rear end of the spring member 9. The male screw 5*d* is screwed into the female screw member 8, and forms a first part of a screwing portion (or screw coupling) T formed by the pusher bar 5 and the female screw member 8.

Figure 8A:
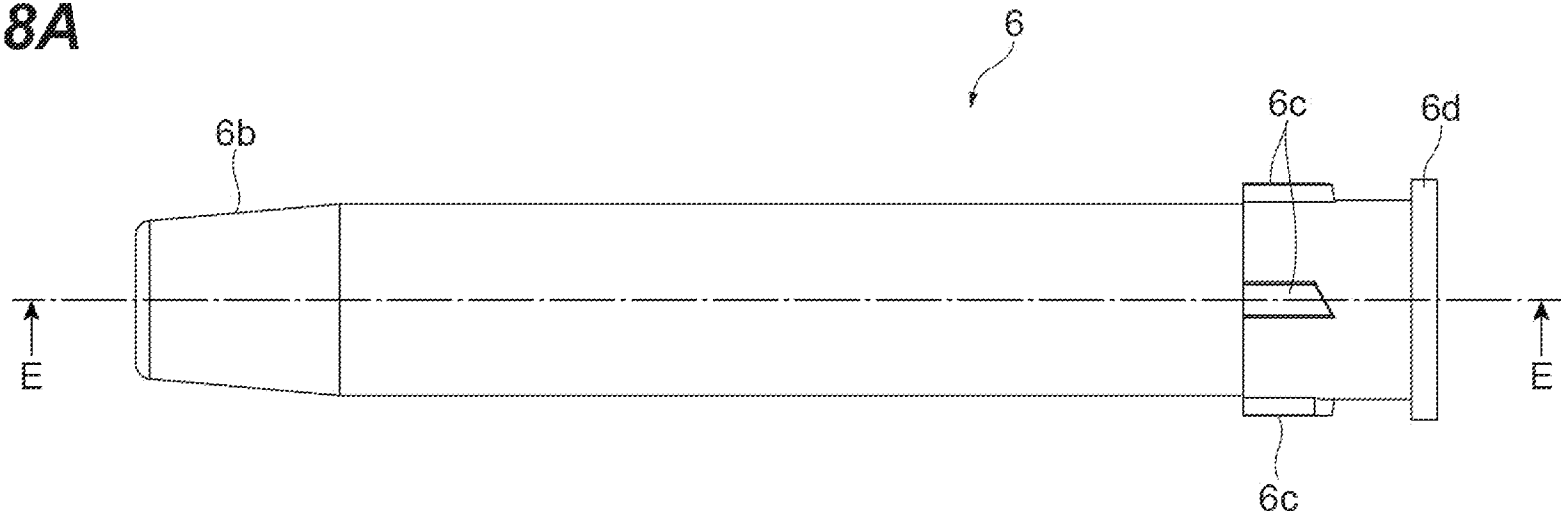
FIG. 8A is a side view illustrating a rotation stopper member of the cosmetic material feeding container of FIG. 1.
Figure 8B:
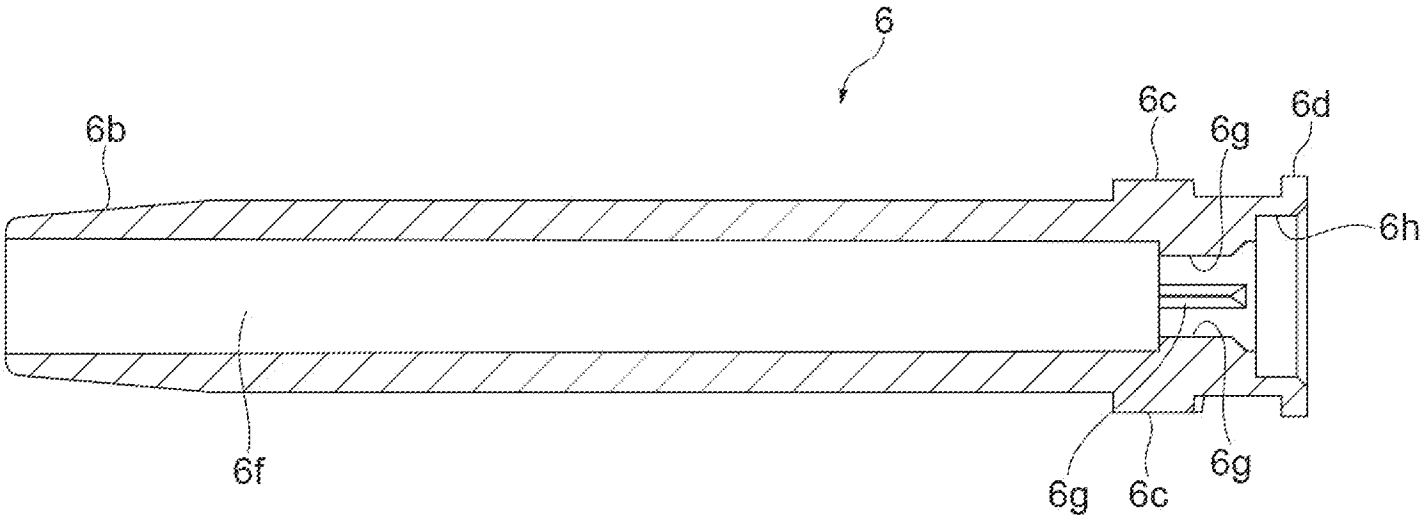
FIG. 8B is a cross-sectional view taken along line E-E of the rotation stopper member of FIG. 8A.
Figure 9:
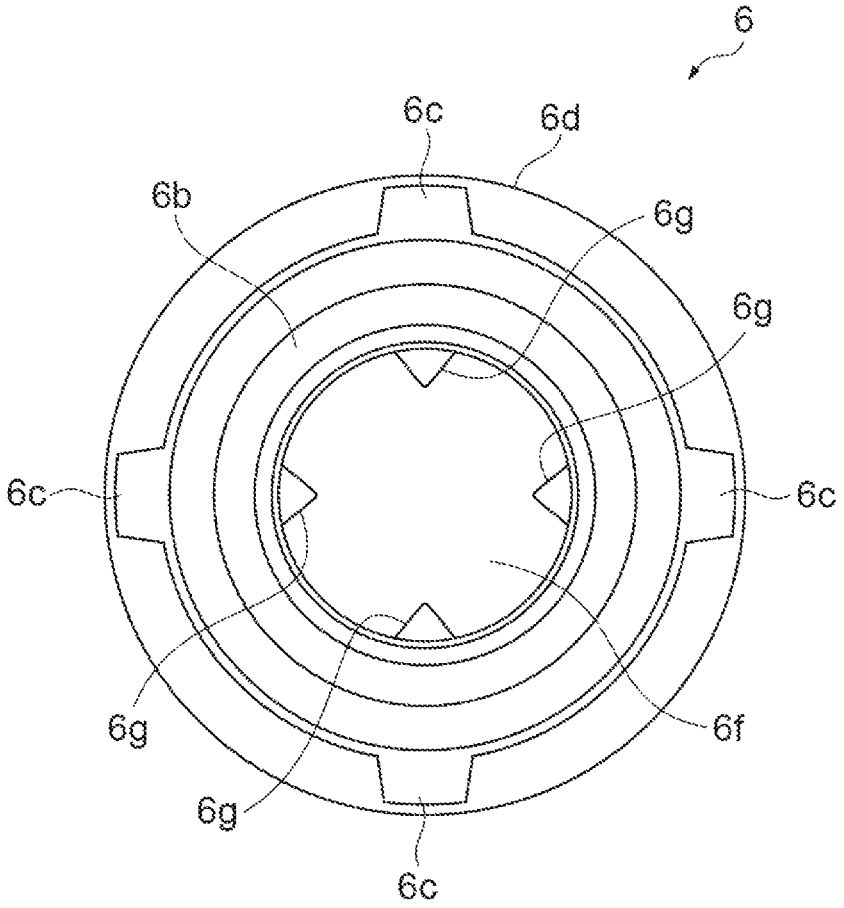
FIG. 9 is a front view of the rotation stopper member of FIG. 8A.

FIG. 8A is a side view illustrating the rotation stopper member 6. FIG. 8B is a cross-sectional view of the rotation stopper member 6 illustrated in FIG. 8A, taken along line E-E. FIG. 9 is a front view of the rotation stopper member 6 (e.g., when the rotation stopper member 6 is viewed from the front side). The rotation stopper member 6 has a stepped cylindrical shape. As illustrated in FIGS. 3, 8A, 8B, and 9, an inner surface of the rotation stopper member 6 has a pusher bar insertion region 6*f* into which the pusher bar 5 is inserted, a ridge 6*g* located on a rear side of the pusher bar insertion region 6*f*, and an enlarged diameter hole portion 6*h* open rearwardly behind the ridge 6*g*.

In some examples, the pusher bar insertion region 6*f* has a cylindrical hole shape extending rearwardly from a front end of the rotation stopper member 6. The rotation stopper member 6 has a plurality of ridges 6*g*. Each of the ridges 6*g* protrudes inwardly in the radial direction of the rotation stopper member 6, and extends in the axial direction. The plurality of ridges 6*g* are disposed to be aligned along the circumferential direction of the rotation stopper member 6.

In some examples, the number of the ridges 6*g* is four, and the four ridges 6*g* are disposed at an equal interval along the circumferential direction. The bar-shaped portion 5*f* of the pusher bar 5 engages with the ridge 6*g* in the circumferential direction, and the bar-shaped portion 5*f* engages with the ridge 6*g*, thereby stopping the rotation of the pusher bar 5 with respect to the rotation stopper member 6. The enlarged diameter hole portion 6*h* is a portion where the other end (front end) of the spring member 9 enters.

The enlarged diameter hole portion 6*h* is a portion that supports a front end of the spring member 9. The spring member 9 is disposed to extend in the axial direction between the enlarged diameter portion 5*c* of the pusher bar 5 and the enlarged diameter hole portion 6*h* of the rotation stopper member 6. The spring member 9 biases the pusher bar 5 rearwardly (toward the rear end 5*g* of the pusher bar 5), and biases the rotation stopper member 6 forwardly.

An outer peripheral surface of the rotation stopper member 6 includes a tapered surface 6*b* located on the front side, a projection portion 6*c* located behind the tapered surface 6*b*, and a flange portion 6*d* located behind the projection portion 6*c*. The tapered surface 6*b* is a portion inserted into the leading cylinder 2 from the rear.

The projection portion 6*c* extends in the axial direction on the outer peripheral surface of the rotation stopper member 6, and a plurality of the projection portions 6*c* are disposed along the circumferential direction of the rotation stopper member 6. In some examples, the number of the projection portions 6*c* is four, and the four projection portions 6*c* are disposed at an equal interval in the circumferential direction. For example, a position of each of the projection portions 6*c* in the circumferential direction may be the same as a position of each of the ridges 6*g* in the circumferential direction. The projection portion 6*c* is a portion that contacts the rear end of the leading cylinder 2 and engages with the ratchet member 7 in the circumferential direction in a state where the leading cylinder 2 is attached.

The flange portion 6*d* is a portion that engages with the ratchet member 7 in the axial direction. The front end of the flange portion 6*d* comes into contact with the ratchet member 7 so that the rotation stopper member 6 engages with the ratchet member 7 in the axial direction. In this way, the rotation stopper member 6 engages with the ratchet member 7 in the axial direction to prevent the rotation stopper member 6 from falling off from the ratchet member 7.

Figure 10A:
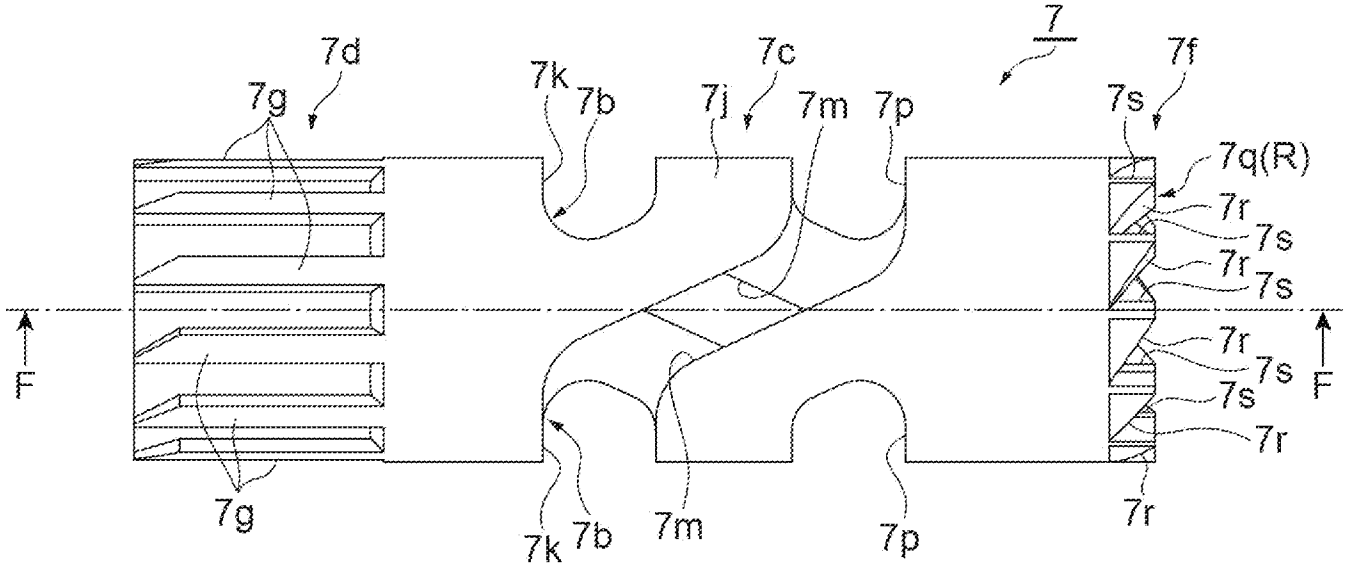
FIG. 10A is a side view illustrating a ratchet member of the cosmetic material feeding container of FIG. 1.
Figure 10B:
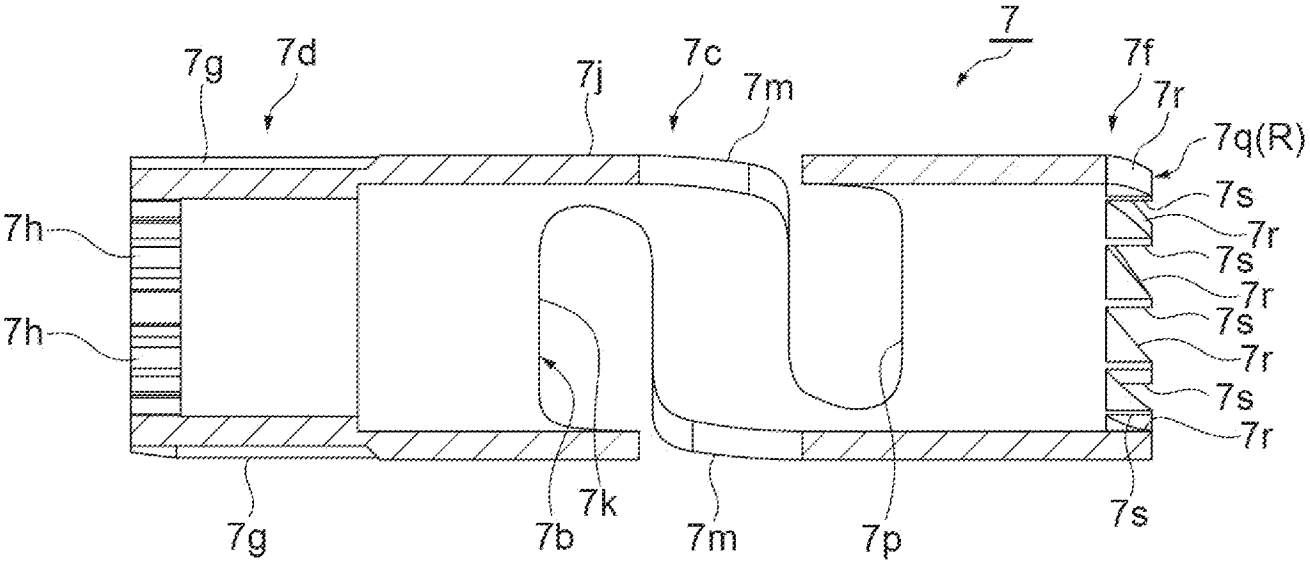
FIG. 10B is a cross-sectional view taken along line F-F of the ratchet member of FIG. 10A.
Figure 11A:
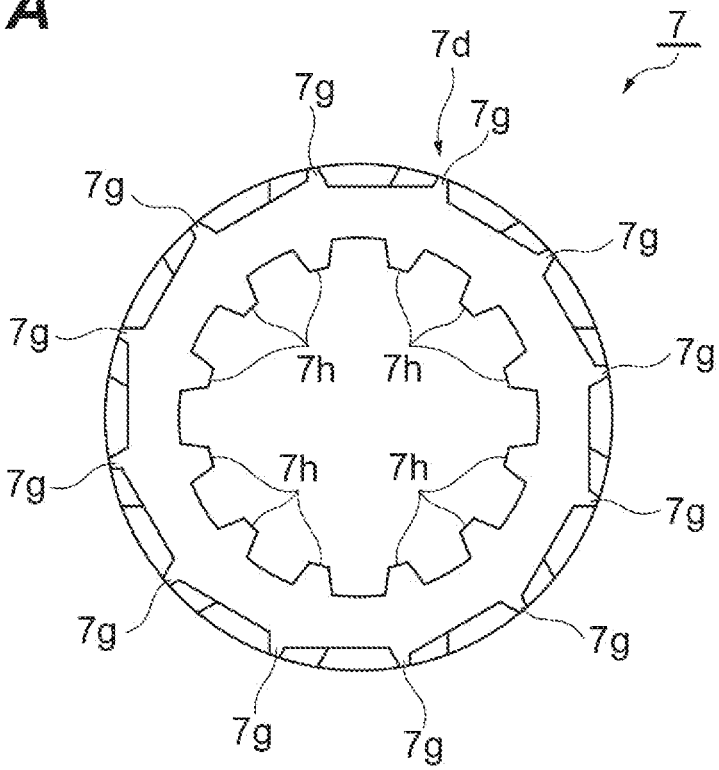
FIG. 11A is a front view of the ratchet member of FIG. 10A.
Figure 11B:
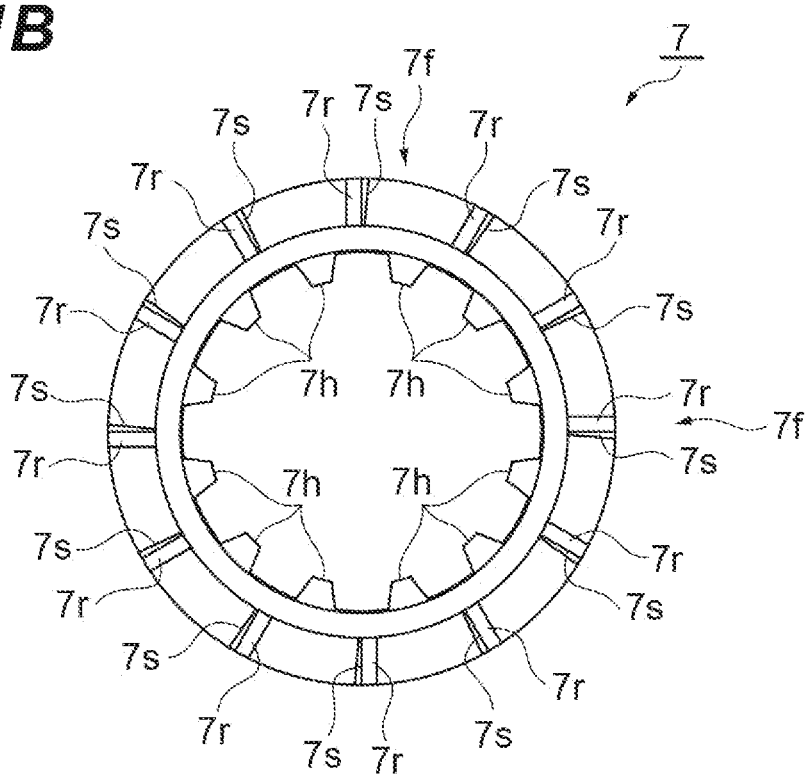
FIG. 11B is a rear view of the ratchet member of FIG. 10A.

FIG. 10A is a side view illustrating the ratchet member 7. FIG. 10B is a cross-sectional view of the ratchet member 7 illustrated in FIG. 10A, taken along line F-F. FIG. 11A is a front view of the ratchet member 7 (e.g., when the ratchet member 7 is viewed from the front side). FIG. 11B is a rear view of the ratchet member 7 (e.g., when the ratchet member 7 is viewed from the rear side). As illustrated in FIGS. 3, 10A, 10B, 11A, and 11B, the ratchet member 7 has a substantially cylindrical shape having a spring portion 7*c* in which a slit 7*b* is formed in a central portion thereof in the axial direction.

The ratchet member 7 includes a front cylinder portion 7*d* with which the rotation stopper member 6 engages, the above-described spring portion 7*c*, and a rear cylinder portion 7*f* with which the female screw member 8 engages. The outer peripheral surface of the front cylinder portion 7*d* has a plurality of ridges 7*g* extending in the axial direction, and the plurality of ridges 7*g* are disposed to be aligned along the circumferential direction. The ridge 7*g* is a portion that engages with a knurl 3*b* formed on the inner surface of the container body 3 in a rotation direction.

The front cylinder portion 7*d* has a plurality of projection portions 7*h* extending in the axial direction on the inner surface of the ratchet member 7, and the plurality of projection portions 7*h* are disposed to be aligned along the circumferential direction. The rotation stopper member 6 can move in the axial direction with respect to the ratchet member 7. When the rotation stopper member 6 is located rearwardly, the projection portion 7*h* of the ratchet member 7 engages with the projection portion 6*c* of the rotation stopper member 6 in the circumferential direction. Then, when the rotation stopper member 6 is located forwardly, the projection portion 7*h* of the ratchet member 7 disengages from the projection portion 6*c* in the circumferential direction.

The spring portion 7*c* is formed in a substantially cylindrical shape. For example, the outer diameter of the spring portion 7*c* is greater than the outer diameter of the front cylinder portion 7*d*. The spring portion 7*c* is a portion forming a resin spring which is expandable and contractible in the axial direction. The spring portion 7*c* has a main body portion 7*j* and a pair of slits 7*b* extending along a peripheral surface of the main body portion 7*j* and through which the inside and the outside of the main body portion 7*j* communicate with each other. The slit 7*b* has a first extending portion 7*k* extending in the circumferential direction of the ratchet member 7, an inclined portion 7*m* extending obliquely rearwardly from an end portion in the circumferential direction of the first extending portion 7*k*, and a second extending portion 7*p* extending in the circumferential direction of the ratchet member 7 from a rear end of the inclined portion 7*m*.

The rear cylinder portion 7*f* has a second ratchet tooth 7*q* that engages with a first ratchet tooth 8*b* formed in the female screw member 8. The above-described ratchet mechanism R is configured to include the first ratchet tooth 8*b* and the second ratchet tooth 7*q*. The second ratchet tooth 7*q* is formed in the rear end of the ratchet member 7. The second ratchet tooth 7*q* includes an inclined surface 7*r* that is inclined with respect to the axial direction, and a wall surface 7*s* extending toward the rear end of the inclined surface 7*r* in the axial direction. The inclined surface 7*r* and the wall surface 7*s* are aligned with each other in the circumferential direction of the ratchet member 7.

An inclined surface and a wall surface which are similar to the inclined surface 7*r* and the wall surface 7*s* are formed in the first ratchet tooth 8*b* of the female screw member 8. The inclined surface of the first ratchet tooth 8*b* faces the inclined surface 7*r* in the circumferential direction, and the wall surface of the first ratchet tooth 8*b* faces the wall surface 7*s* in the circumferential direction. The ratchet member 7 can rotate in the first direction ("one direction") with respect to the female screw member 8 so that the inclined surface 7*r* rides across the inclined surface of the female screw member 8. However, when a rotational force is applied to the ratchet member 7 in the second direction (opposite to the first direction) with respect to the female screw member 8, the wall surface 7*s* contacts the wall surface of the female screw member 8, thereby restricting the rotation in the second opposite.

In some examples, the female screw member 8 may have a stepped cylindrical shape including an annular projection portion 8*f* having the first ratchet tooth 8*b*. The annular projection portion 8*f* is formed at the center of the female screw member 8 in the axial direction. A front side portion of the female screw member 8 from the annular projection portion 8*f* is inserted into the ratchet member 7, and a rear side portion of the female screw member 8 from the annular projection portion 8*f* is inserted into the tail plug 4.

A female screw (or female screw thread) 8*c* to which the male screw 5*d* of the pusher bar 5 is screwed and an accommodation region 8*d* located on a front side of the female screw 8*c* are formed on an inner periphery of the female screw member 8. The female screw 8*c* extends forwardly in a spiral shape from the rear end portion of the female screw member 8, and the male screw 5*d* formed in the enlarged diameter portion 5*c* of the pusher bar 5 is screwed into the female screw 8*c*. The female screw 8*c* forms a second part of the above-described screwing portion T. That is, the screwing portion T is configured to include the female screw 8*c* and the male screw 5*d* of the pusher bar 5.

A portion of the pusher bar 5 and a portion of the spring member 9 are accommodated in the accommodation region 8*d*. As described above, a rear end of the spring member 9 is supported by the pusher bar 5, and a front end of the spring member 9 is supported by the rotation stopper member 6. The spring member 9 extends in the axial direction between the enlarged diameter portion 5*c* of the pusher bar 5 and the rotation stopper member 6, inside the ratchet member 7 and inside the female screw member 8.

The tail plug 4 is provided on the rear side of the female screw member 8. The tail plug 4 is provided to close an opening (e.g., an open end) 3*g* formed in a rear end of the container body 3. The tail plug 4 includes a cylindrical insertion portion 4*b* to be inserted into the container body 3 and a cylinder portion 4*c* located on the rear side of the insertion portion 4*b*. The diameter of the insertion portion 4*b* is smaller than the diameter of the cylinder portion 4*c*, and the outer diameter of the cylinder portion 4*c* is approximately the same as the outer diameter of the container body 3. The tail plug 4 can rotate relative to the container body 3 in the circumferential direction, and functions as an operation cylinder in which an operation for feeding the cosmetic material M is performed by rotating the tail plug 4 relative to the container body 3.

An accommodation region 4*d* that accommodates a rear side portion of the female screw member 8 is provided on an inner surface of the insertion portion 4*b*. The outer peripheral surface of the insertion portion 4*b* has an annular projection portion 4*f* that engages with an annular recess portion 3*c* formed on the inner surface of the container body 3 in the axial direction and an annular recess portion 4*g* that accommodates an O-ring 22. The O-ring 22 accommodated in the annular recess portion 4*g* is provided in close contact with the inner surface of the container body 3 to provide airtightness inside the container body 3.

An operation of the above-described example cosmetic material feeding container 100 will be described. First, the cap 10 is detached from the leading cylinder 2, and the container body 3 is rotated in a first direction relative to the tail plug 4. When the container body 3 is rotated in the first direction relative to the tail plug 4, the tail plug 4 and the female screw member 8 which are rotationally fixed together, are synchronously rotated, and the container body 3, the ratchet member 7, the leading cylinder 2, the tube 1, and the pusher bar 5 which are rotationally fixed together, are synchronously rotated. In this manner, a screwing action of the screwing portion T causes the pusher bar 5 to move forwardly with respect to the female screw member 8. As the pusher bar 5 moves forwardly, the pusher bar 5 pushes the cosmetic material M forwardly inside the tube 1, and the cosmetic material M protruding forwardly from the leading cylinder 2 may be applied to an application target portion (for example, a surface such as the skin of a user). In this manner, the cosmetic material M may be applied.

The spring member 9 gradually contracts as the pusher bar 5 moves forwardly. In addition, the ratchet mechanism R restricts the rotation of the ratchet member 7 relative to the female screw member 8 in the second direction opposite to the first direction. Accordingly, the rotation of the container body 3 relative to the tail plug 4 in the second direction is restricted. Accordingly, the pusher bar 5 does not move rearwardly until the cosmetic material M is substantially consumed. In addition, in a state where the leading cylinder 2 is attached to the container body 3, the projection portion 6*c* of the rotation stopper member 6 engages with the projection portion 7*h* of the ratchet member 7 in the circumferential direction. Accordingly, the rotation stopper member 6 is rotated synchronously (rotationally fixed) with the ratchet member 7.

Figure 12:
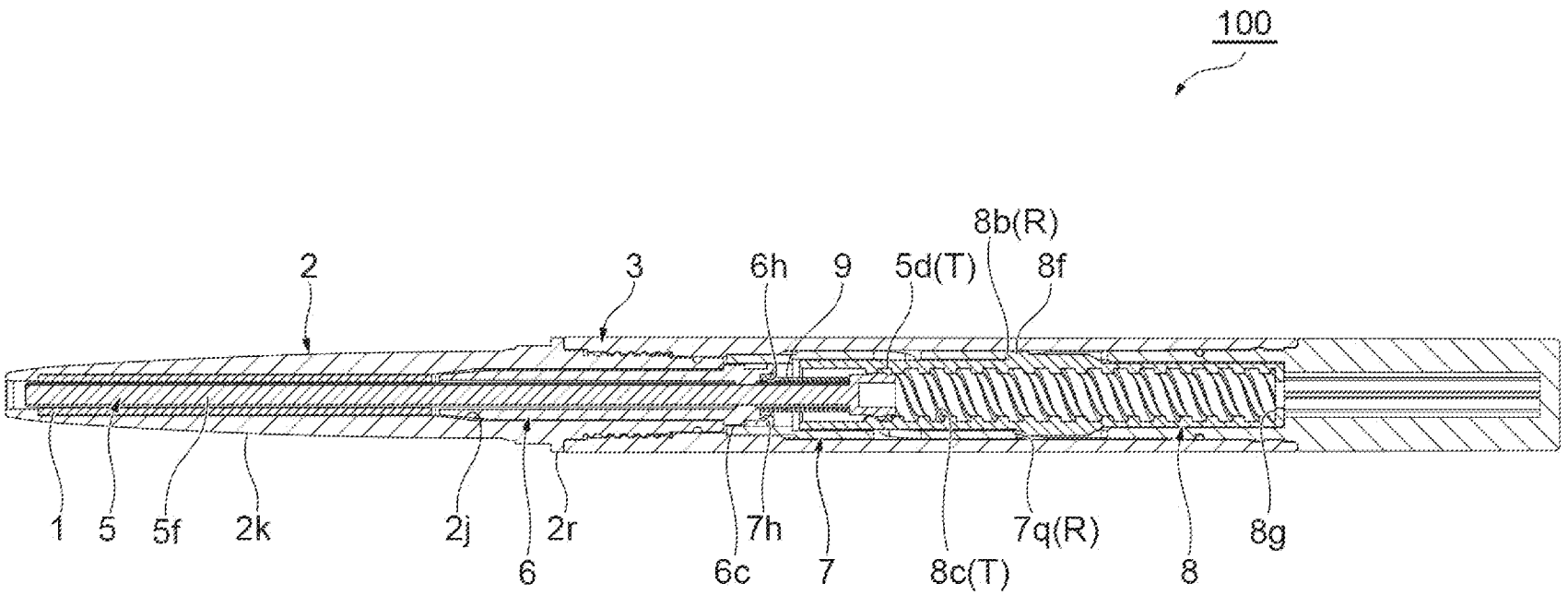
FIG. 12 is a cross-sectional view illustrating a state where a cap is detached from the cosmetic material feeding container of FIG. 3.
Figure 13:
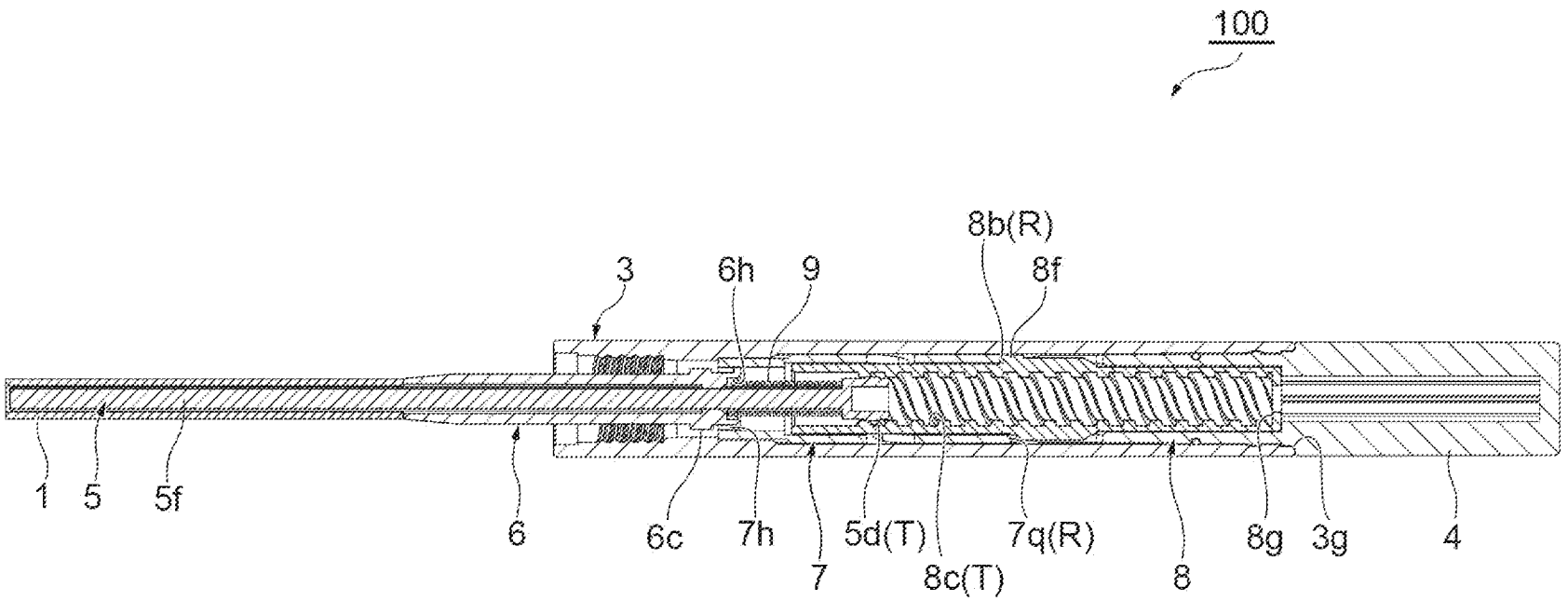
FIG. 13 is a cross-sectional view illustrating a state where the leading cylinder is detached from the cosmetic material feeding container of FIG. 12.
Figure 14:
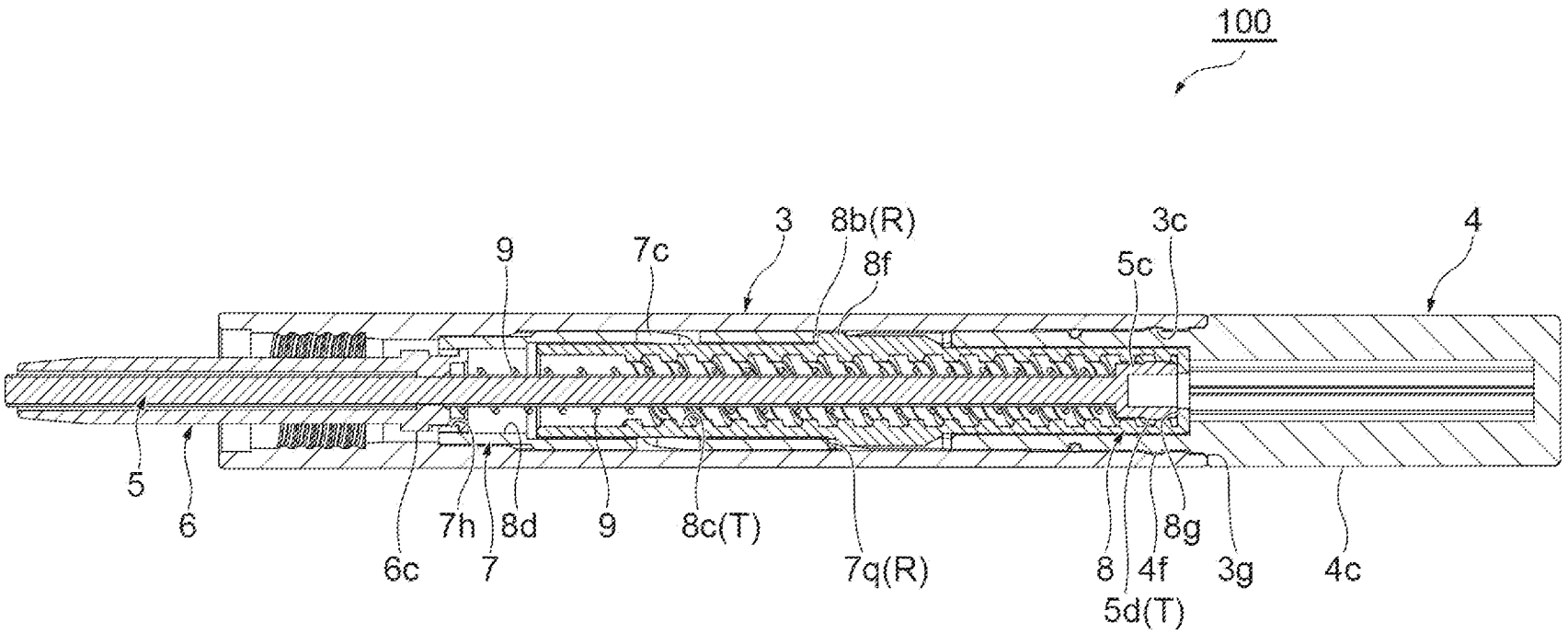
FIG. 14 is a cross-sectional view illustrating a state where the tube is detached from the cosmetic material feeding container of FIG. 13.

When the cosmetic material M is used or consumed, and the cosmetic material M inside the tube 1 is no longer present, as illustrated in FIGS. 12, 13, and 14, the pusher bar 5 reaches a forward movement limit, and the front end of the pusher bar 5 protrudes forwardly from the tube 1. The leading cylinder 2 may be detached from the container body 3, to replace the tube 1. Accordingly, the tube 1 alone can be removed, to be replaced with a new tube.

Namely, the pusher bar 5 is inserted into the tube 1, and the tube 1 can be replaced by detaching the tube 1 from the pusher bar 5. First, when the leading cylinder 2 is detached from the container body 3 to replace (exchange) the tube 1, the projection portion 6*c* of the rotation stopper member 6 is moved forwardly with respect to the projection portion 7*h* of the ratchet member 7 by a biasing force of the spring member 9. In this state, the rotation stopper member 6 disengages from the ratchet member 7 in the circumferential direction, and can rotate with respect to the ratchet member 7.

Before the leading cylinder 2 is detached from the container body 3 and the tube 1 is replaced, the pusher bar 5 engages with the tube 1 due to a frictional force. However, when the tube 1 is detached from the pusher bar 5, the pusher bar 5 disengages from the tube 1, and the rotation stopper member 6 and the pusher bar 5 rotate with respect to the ratchet member 7. The pusher bar 5 moves rearwardly while being rotated by the biasing force of the spring member 9. At this time, the rear end of the pusher bar 5 comes into contact with a bottom surface 8*g* of the female screw member 8, and the pusher bar 5 is positioned in an initial state, as illustrated in FIG. 3.

Figure 15:
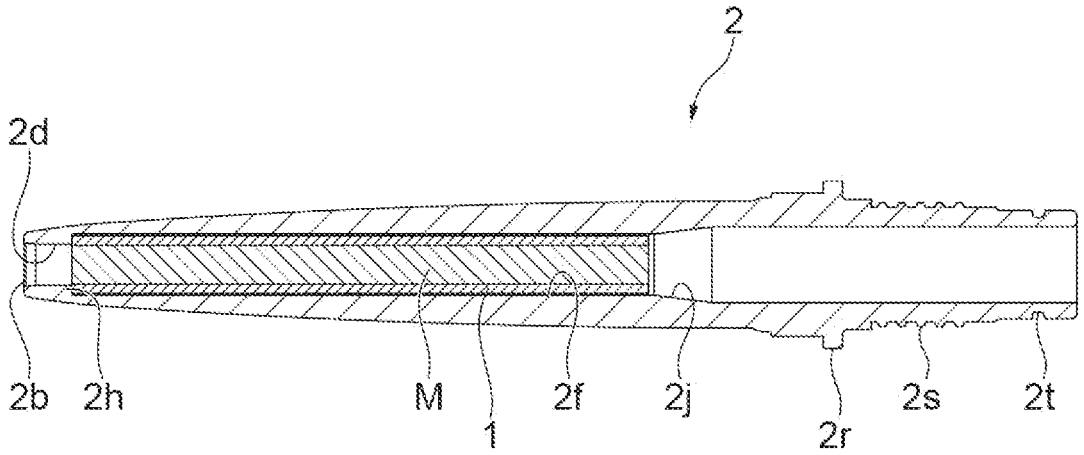
FIG. 15 is a cross-sectional view illustrating the leading cylinder provided with a new tube, in the cosmetic material feeding container illustrated in FIG. 1.
Figure 16:
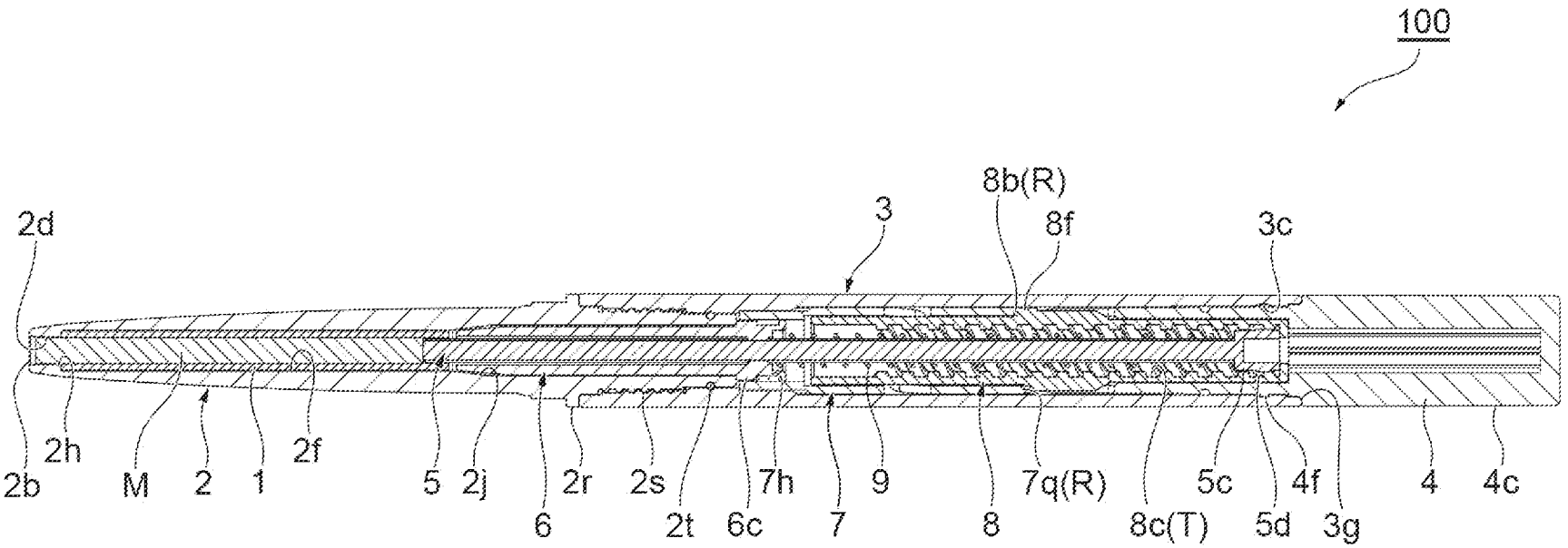
FIG. 16 is a cross-sectional view illustrating a state where the leading cylinder of FIG. 15 is attached to the cosmetic material feeding container of FIG. 14.

As illustrated in FIG. 15, a new tube 1 accommodating the cosmetic material M is inserted into the leading cylinder 2 which is detached from the container body 3. At this time, the tube 1 may be inserted into the central accommodation region 2*f* from the rear side of the leading cylinder 2, so that the front end of the tube 1 comes into contact with the step portion 2*h*. Then, as illustrated in FIGS. 15 and 16, the leading cylinder 2 in which the tube 1 is inserted may be attached to the container body 3 illustrated in FIG. 14. In this manner, the leading cylinder 2 holding the new tube 1 is attached to the container body 3, and the tube 1 is entirely replaced.

Operational effects that may be achieved with the example cosmetic material feeding container 100 will be described. In the cosmetic material feeding container 100, the tube 1 that accommodates the cosmetic material M is provided inside the leading cylinder 2, and the leading cylinder 2 engages with the container body 3 to be attachable and detachable. The cylindrical female screw member 8 is provided inside the container body 3, and the female screw member 8 has the female screw 8*c* into which the male screw 5*d* of the pusher bar 5 is screwed. The pusher bar 5 is restricted in rotation in the circumferential direction, by the rotation stopper member 6, and is moved forwardly by the screwing action between the male screw 5*d* and the female screw 8*c* (screwing portion T).

At this time, the cosmetic material M accommodated in the tube 1 is pushed by the forwardly moving pusher bar 5. In this manner, the cosmetic material M may be applied by being exposed from the opening 2*b* of the leading cylinder 2. The leading cylinder 2 is attachable to and detachable from the container body 3. As illustrated in FIG. 13, the tube 1 can be replaced in a state where the leading cylinder 2 is detached from the container body 3. Therefore, the tube 1 alone can be replaced when the leading cylinder 2 is detached from the container body 3, so as to reduce the number of components to be discarded. Accordingly, the number of components to be discarded after the cosmetic material M is used can be reduced.

The pusher bar 5 moves forwardly as the container body 3 rotates in the first direction, and the ratchet member 7 that is provided inside the container body 3 restricts the rotation of the container body 3 in the second direction (opposite to the first direction). The ratchet member 7 includes the second ratchet tooth 7*q* that engages with the first ratchet tooth 8*b* formed in the female screw member 8. Therefore, the pusher bar 5 moves forwardly as the container body 3 rotates in the first direction, and the rotation of the container body 3 in the second direction is restricted by the ratchet member 7. Consequently, the rotation of the container body 3 in the second direction may be restricted, to prevent an unintended rearward movement of the cosmetic material M and the pusher bar 5.

The rotation stopper member 6 having a substantially cylindrical shape, engages with the ratchet member 7 to be synchronously rotatable therewith. When the leading cylinder 2 is detached from the container body 3, the rotation stopper member 6 moves forwardly, disengages from the ratchet member 7, and can rotate in the circumferential direction with respect to the ratchet member 7. Therefore, when the leading cylinder 2 is detached from the container body 3, the rotation stopper member 6 moves forwardly, disengages from the ratchet member 7, and can rotate with respect to the ratchet member 7. Therefore, the pusher bar 5 is also rotated by the rotation of the rotation stopper member 6 with respect to the ratchet member 7. In this manner, the pusher bar 5 can move rearwardly in a state where the leading cylinder 2 is detached from the container body 3.

The cosmetic material feeding container 100 includes the tail plug 4 located on the side opposite to the leading cylinder 2 in the container body 3. The tail plug 4 seals the opening 3*g* located on the side opposite to the leading cylinder 2 in the container body 3. Therefore, the airtightness of the cosmetic material feeding container 100 can be ensured by the tail plug 4 sealing the opening 3*g* of the container body 3.

The tube 1 can engage with the pusher bar 5 along the axial direction of the tube 1, and the tube 1 can be replaced by being detached from the pusher bar 5. The cosmetic material feeding container 100 includes the spring member 9 that biases the pusher bar 5 to move the pusher bar 5 rearwardly when the tube 1 is detached from the pusher bar 5. Therefore, when the tube 1 engages with the pusher bar 5, a state where the pusher bar 5 is moved forwardly is maintained by the engagement. Then, when the tube 1 is detached from the pusher bar 5, the tube 1 disengages from the pusher bar 5. Accordingly, the pusher bar 5 is automatically moved rearwardly by the biasing force of the spring member 9. Therefore, the pusher bar 5 can automatically return to the initial state when the tube 1 is replaced. Accordingly, a new tube 1 can be easily attached, so as to improve ease of use of the cosmetic material feeding container 100.

Although examples of the cosmetic material feeding container have been described, the present disclosure is not limited to the above-described examples, and the cosmetic material feeding container may be modified according to other examples. Namely, a shape, a size, the number, a material, and a disposition mode of each component of the cosmetic material feeding container can be suitably modified.

Figure 17:
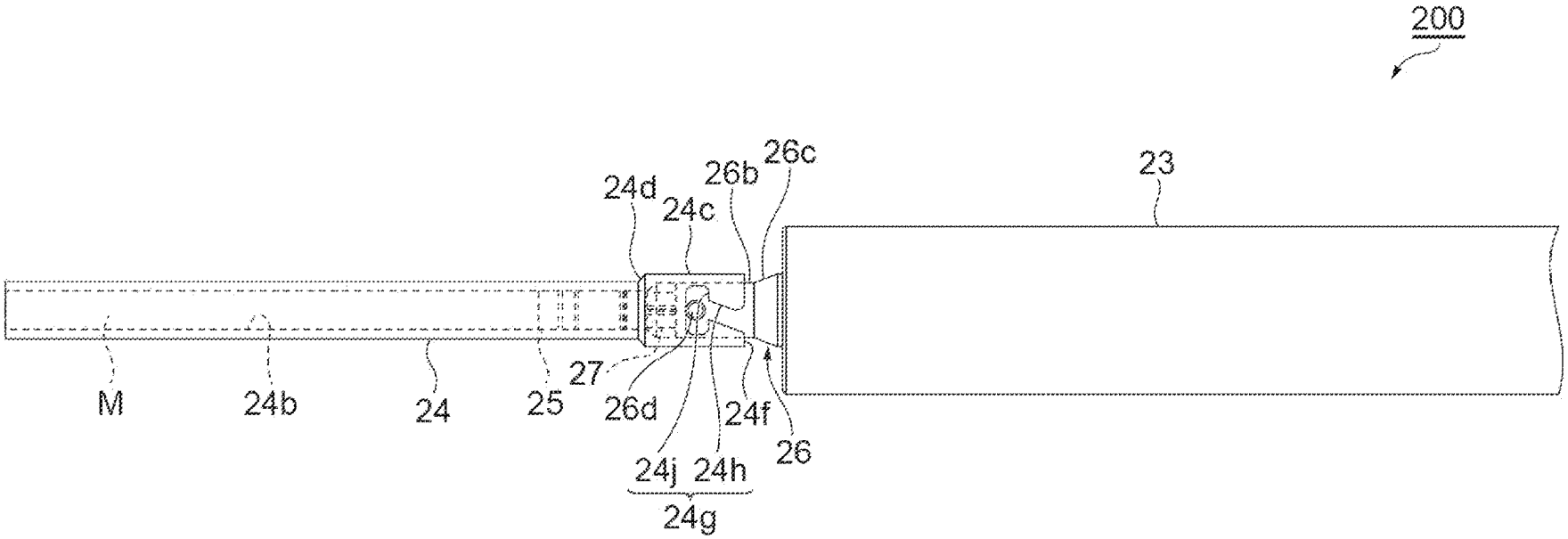
FIG. 17 is a side view illustrating a tube, a cosmetic material, a pusher bar, and a rotation stopper member of a cosmetic material feeding container according to another example.
Figure 18:
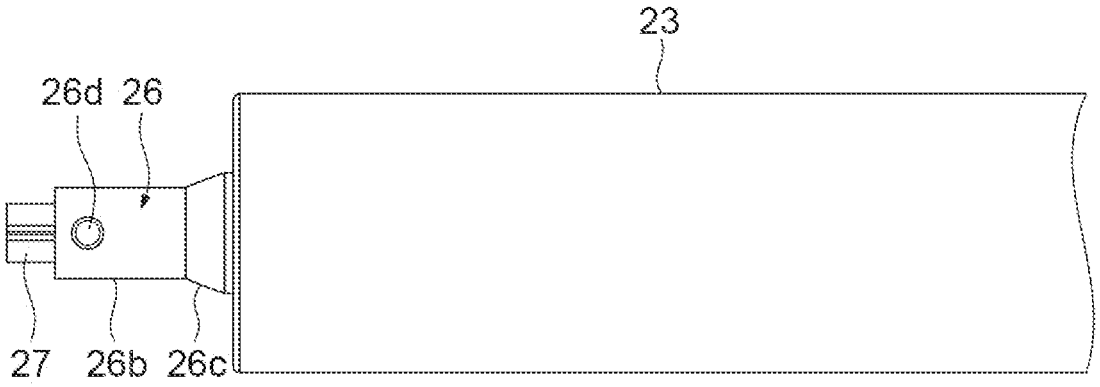
FIG. 18 is an enlarged side view of the rotation stopper member and a container body illustrated in FIG. 17.

FIG. 17 is a side view illustrating a container body 23, a tube 24, a piston 25, a rotation stopper member 26, a pusher bar 27, and a cosmetic material M of a cosmetic material feeding container 200 according to a modification example. FIG. 18 is an enlarged side view of the container body 23 and the rotation stopper member 26 illustrated in FIG. 17. As illustrated in FIGS. 17 and 18, the container body 23 has a substantially cylindrical shape, and the rotation stopper member 26 protrudes from the front end of the container body 23. According to examples, a configuration of the container body 23 may be the same as or similar to a configuration of the previously-described container body 3 (cf. FIGS. 2 and 3).

The tube 24 has a cylindrical cosmetic accommodation portion 24*b* that accommodates the cosmetic material M, an enlarged diameter portion 24*c* located behind the cosmetic accommodation portion 24*b*, and a tapered surface 24*d* located between the cosmetic accommodation portion 24*b* and the enlarged diameter portion 24*c*. The piston 25 is located on the rear side of the cosmetic material M and on the front side of the pusher bar 27, and is provided to push the cosmetic material M forwardly.

The rotation stopper member 26 includes a tapered surface 26*c* exposed from the container body 23 and having a diameter that decreases away from the container body 23, and a cylindrical outer peripheral surface 26*b* located on the front side of the tapered surface 26*c*. The outer peripheral surface 26*b* has a projection 26*d* protruding outwardly in the radial direction on the outer peripheral surface 26*b*. The pusher bar 27 protrudes forwardly from the front end of the rotation stopper member 26.

The tube 24 has a groove 24*g* in which the projection 26*d* may be inserted from an end portion 24*f* on the rotation stopper member 26 side, so as to be caught (e.g., locked) in the groove 24*g*. The groove 24*g* has a first extending portion 24*h* extending forwardly obliquely (e.g., at an angle relative to the longitudinal axis) from the end portion 24*f*, and a second extending portion 24*j* extending circumferentially in opposite directions from the front end of the first extending portion 24*h*. For example, the first extending portion 24*h* and the second extending portion 24*j* substantially forms a T-shape. In the tube 24, the projection 26*d* of the rotation stopper member 26 is inserted into the first extending portion 24*h* from the end portion 24*f*, and the tube 24 may be rotated relative to the rotation stopper member 26, so that the projection 26*d* is inserted into the second extending portion 24*j*. In this manner, the tube 24 engages with the rotation stopper member 26 in the axial direction.

As described above, in the cosmetic material feeding container 200 according to the modification example, the rotation stopper member 26 includes the projection 26*d* on the outer peripheral surface 26*b*. The tube 24 has the groove of 24*g* by which projection 26*d* is inserted into from the end portion 24*f* of the tube 24 on the rotation stopper member 26 side. Therefore, the projection 26*d* of the rotation stopper member 26 is caught by the groove 24*g* of the tube 24. In this manner, the tube 24 can engage with the rotation stopper member 26.

Accordingly, in a state where the leading cylinder 2 is detached from the container body 23, the tube 24 may be prevented from being unintentionally detached from the rotation stopper member 26 and the pusher bar 27. In addition, the cosmetic material feeding container 200 according to the modification example includes the piston 25 interposed between the pusher bar 27 and the cosmetic material M. Therefore, the pusher bar 27 does not directly push out the cosmetic material M. Accordingly, the pusher bar 27 can be protected, for example from becoming smeared with the cosmetic material M, by minimizing contact with the cosmetic material M.

The container body 23, the tube 24, the rotation stopper member 26, and the pusher bar 27 according to the modification example can replace the container body 3, the tube 1, the rotation stopper member 6, and the pusher bar 5, respectively, of the example cosmetic material feeding container 100 previously described with reference to FIGS. 1 to 16. Furthermore, the piston 25 can be incorporated into the example cosmetic material feeding container 100.

In addition to the example cosmetic material feeding container 200 described, the cosmetic material feeding container according to the present disclosure can be further modified. A cosmetic material feeding container according to still another example will be described.

Figure 19:
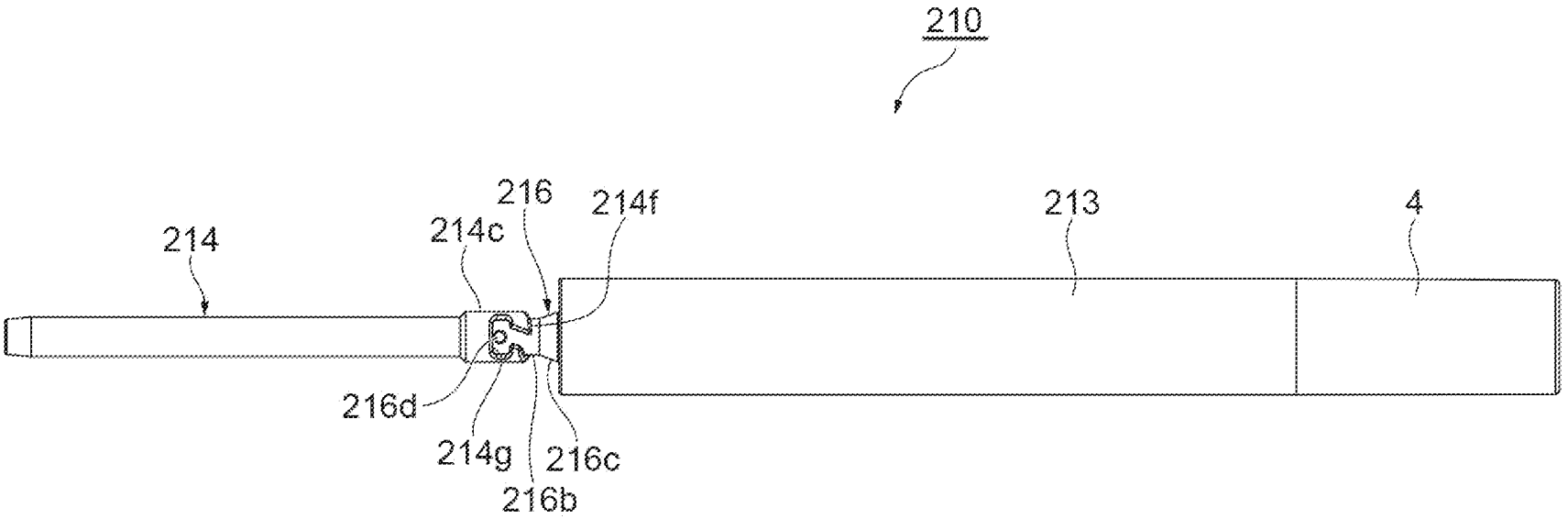
FIG. 19 is a side view illustrating a tube and a rotation stopper member of a cosmetic material feeding container according to another example.
Figure 20A:
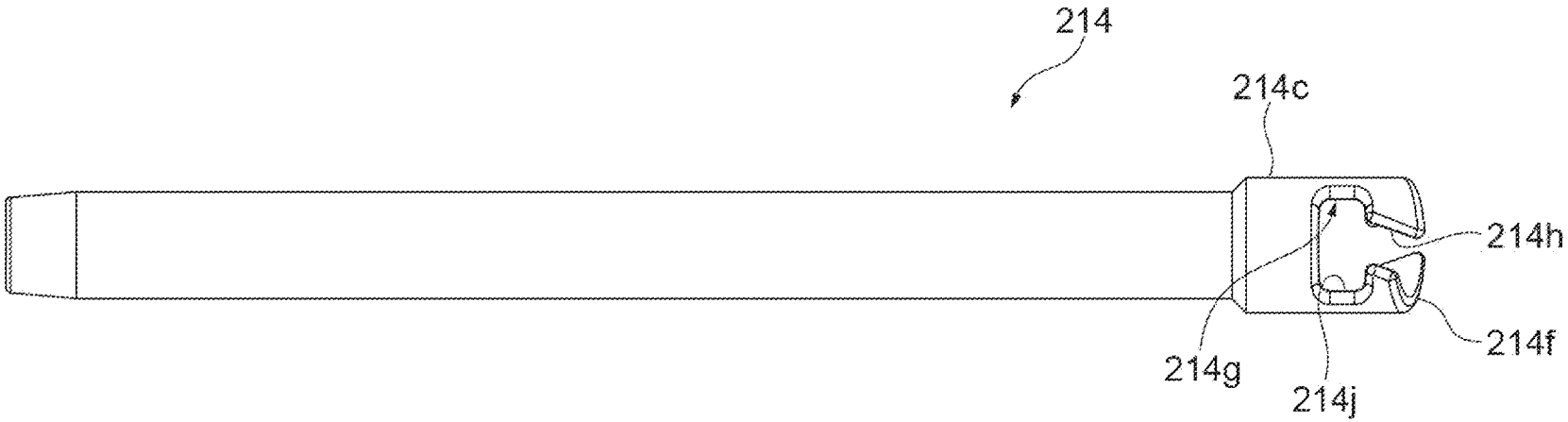
FIG. 20A is a side view illustrating the tube of the cosmetic material feeding container of FIG. 19.
Figure 20B:
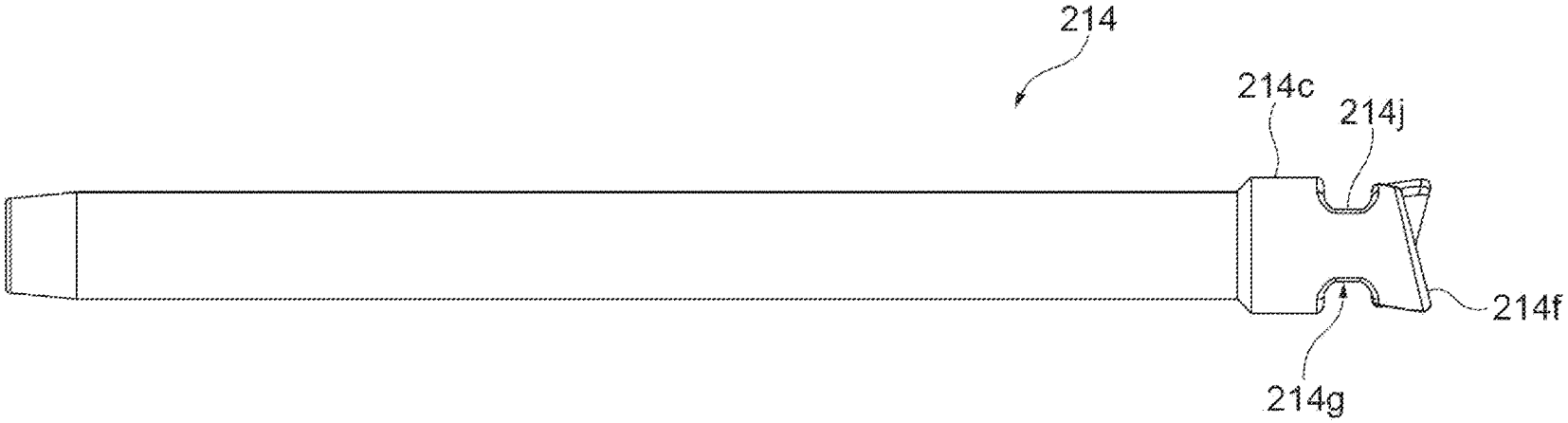
FIG. 20B is a side view illustrating the tube as viewed in a direction different from that in FIG. 20A.

FIG. 19 is a side view illustrating a container body 213, a tube 214, and a rotation stopper member 216 of a cosmetic material feeding container 210 according to another example. FIG. 20A is a side view of the tube 214. FIG. 20B is a side view of the tube 214 when viewed in a direction different from that in FIG. 20A. Some configurations of the container body 213, the tube 214, and the rotation stopper member 216 are the same as some configurations of the container body 23, the tube 24, and the rotation stopper member 26 which are described above. Thus, overlapping description of the above-described contents may be omitted.

The tube 214 has an enlarged diameter portion 214*c* located on the rear side. The rotation stopper member 216 includes a tapered surface 216*c* exposed from the container body 213 and having a diameter that decreases away from the container body 213, and an outer peripheral surface 216*b* located on the front side of the tapered surface 216*c*. The outer peripheral surface 216*b* has a projection 216*d* protruding outwardly in the radial direction from the outer peripheral surface 216*b*.

The tube 214 has an end surface 214*f* facing the rotation stopper member 216, and a locking portion 214*g* formed on the end surface 214*f* and by which the rotation stopper member 216 is caught. The end surface 214*f* of the tube 214 is inclined with respect to a plane orthogonal to the axial direction. The end surface 214*f* may be oriented to form an inclination angle of 14° to 40°, for example, with respect to a plane that is orthogonal to the axial direction. However, the inclination angle of the end surface 214*f* is not limited to the above-described value, and can be suitably changed. A shape of the end surface 214*f* when viewed along the axial direction is an annular shape. In the illustrated example, the end surface 214*f* is inclined obliquely in that the end surface extends rearwardly in a counterclockwise direction along the annular shape.

According to examples, the locking portion 214*g* is a recessed portion where the projection 216*d* of the rotation stopper member 216 enters. According to examples, the tube 214 has two locking portions 214*g* aligned with each other along the circumferential direction of the tube 214. The locking portion 214*g* has a first extending portion 214*h* extending forwardly obliquely from the end surface 214*f*, and a second extending portion 214*j* extending on both sides in the circumferential direction in the front end of the first extending portion 214*h*. In the tube 214, the projection 216*d* of the rotation stopper member 216 is inserted into the first extending portion 214*h* from the end surface 214*f*, and rotates relative to the rotation stopper member 216. The projection 216*d* is caught by the second extending portion 214*j*. In this manner, the tube 214 engages with the rotation stopper member 216 in the axial direction.

As described above, in the example cosmetic material feeding container 210, the projection 216*d* of the rotation stopper member 216 is caught by the locking portion 214*g* of the tube 214. In this manner, the tube 214 can engage with the rotation stopper member 216. In addition, the end surface 214*f* of the tube 214 is inclined with respect to the plane orthogonal to the axial direction. The end surface 214*f* is inclined toward the locking portion 214*g* having a groove shape.

Therefore, when the projection 216*d* engages with the locking portion 214*g*, the projection 216*d* can engage smoothly with the locking portion 214*g* along the inclined end surface 214*f* by bringing the projection 216*d* into contact with the end surface 214*f*. Namely, the projection 216*d* may contact any location of the end surface 214*f*, so as to smoothly guide the projection 216*d* to the second extending portion 214*j* of the tube 214. Accordingly, the rotation stopper member 216 can smoothly engage with the tube 214.

Figure 21:
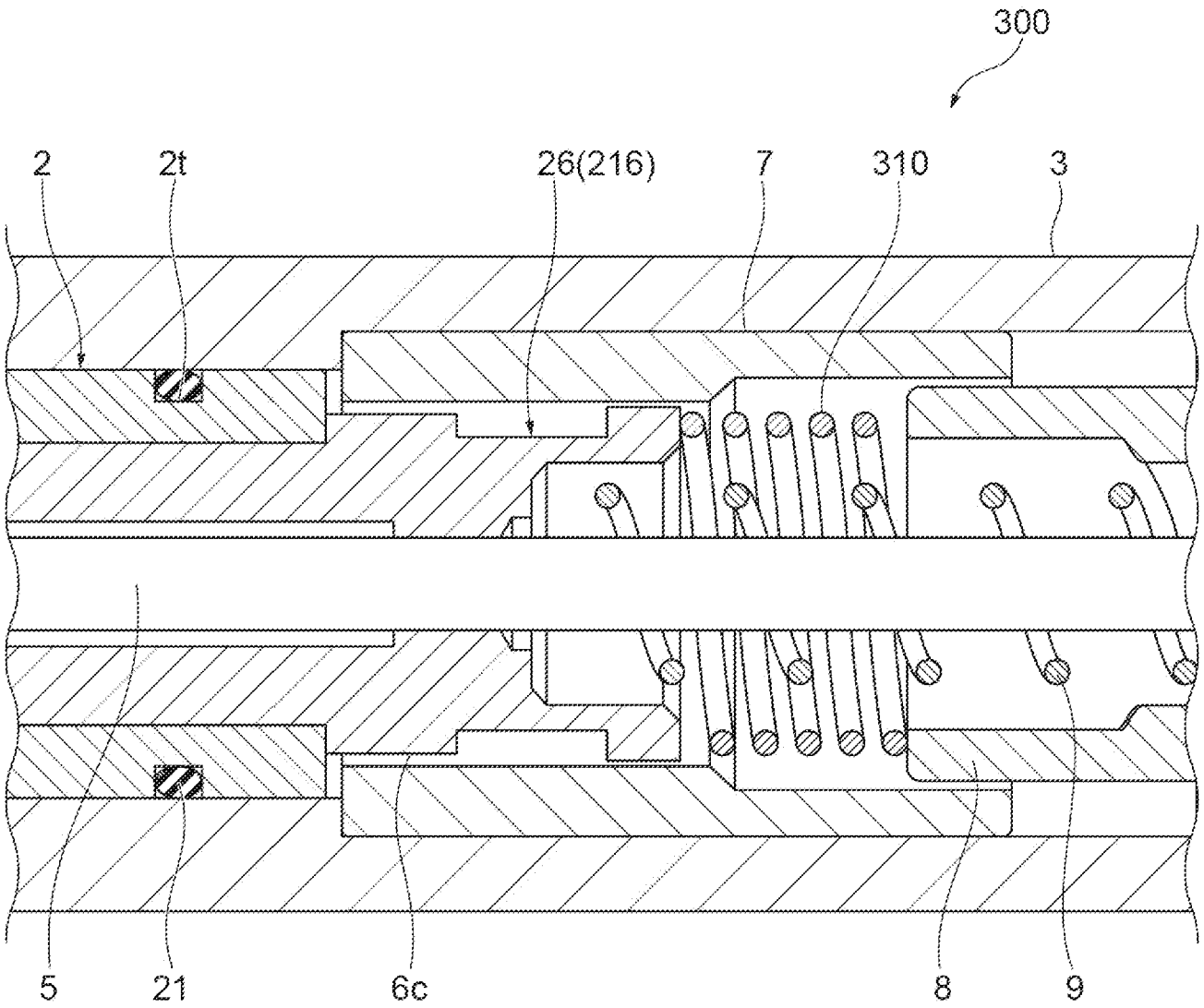
FIG. 21 is a cross-sectional view illustrating an internal structure of a cosmetic material feeding container according to another example.

FIG. 21 is a cross-sectional view illustrating an internal structure of a cosmetic material feeding container 300 according to another example. Similarly to the cosmetic material feeding container 100, the cosmetic material feeding container 200, or the cosmetic material feeding container 210 which are described above, the cosmetic material feeding container 300 includes the leading cylinder 2, the container body 3, the pusher bar 5, and the rotation stopper member 26 (or rotation stopper member 216), the ratchet member 7, the female screw member 8, and the spring member 9.

The example cosmetic material feeding container 300 further includes a second spring member 310. In some examples, the second spring member 310 may be made of steel use stainless (SUS). The second spring member 310 is interposed between the female screw member 8 and the rotation stopper member 26, and is provided to bias the rotation stopper member 26 against the female screw member 8. The second spring member 310 biases the rotation stopper member 26 forwardly.

In some examples, the diameter of the second spring member 310 is greater than the diameter of the spring member 9. The second spring member 310 is disposed to surround the spring member 9 between the rotation stopper member 26 (or the rotation stopper member 216) and the female screw member 8. As described above, the example cosmetic material feeding container 300 includes the second spring member 310 that biases the rotation stopper member 26. In this manner, the rotation stopper member 26 can be biased against the tube 24 side (front side), and the projection 26*d* (or projection 216*d*) can be smoothly guided to the second extending portion 24*j* (or the second extending portion 214*j*).

Figure 22:
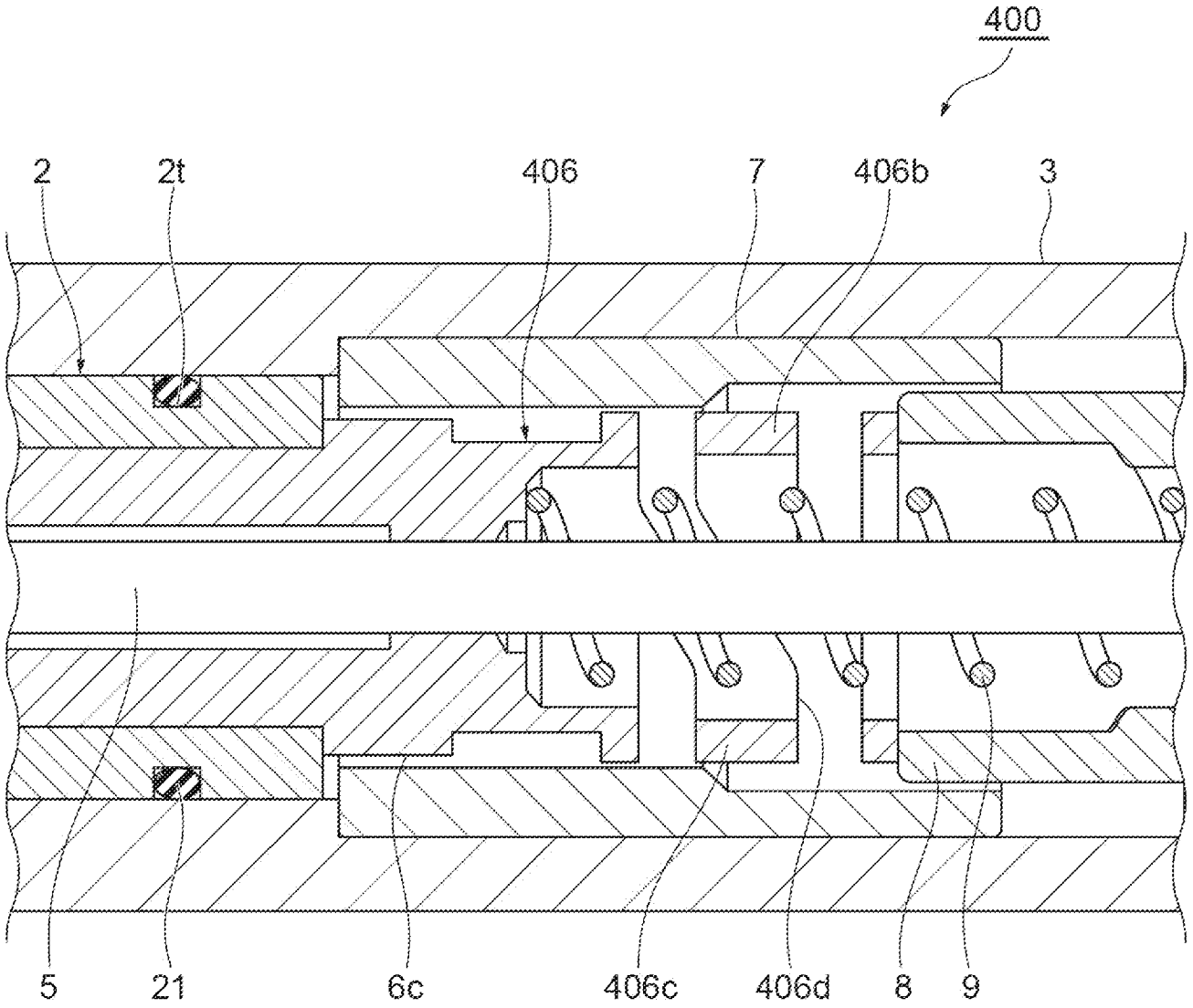
FIG. 22 is a cross-sectional view illustrating an internal structure of a cosmetic material feeding container according to yet another example.
Figure 23A:
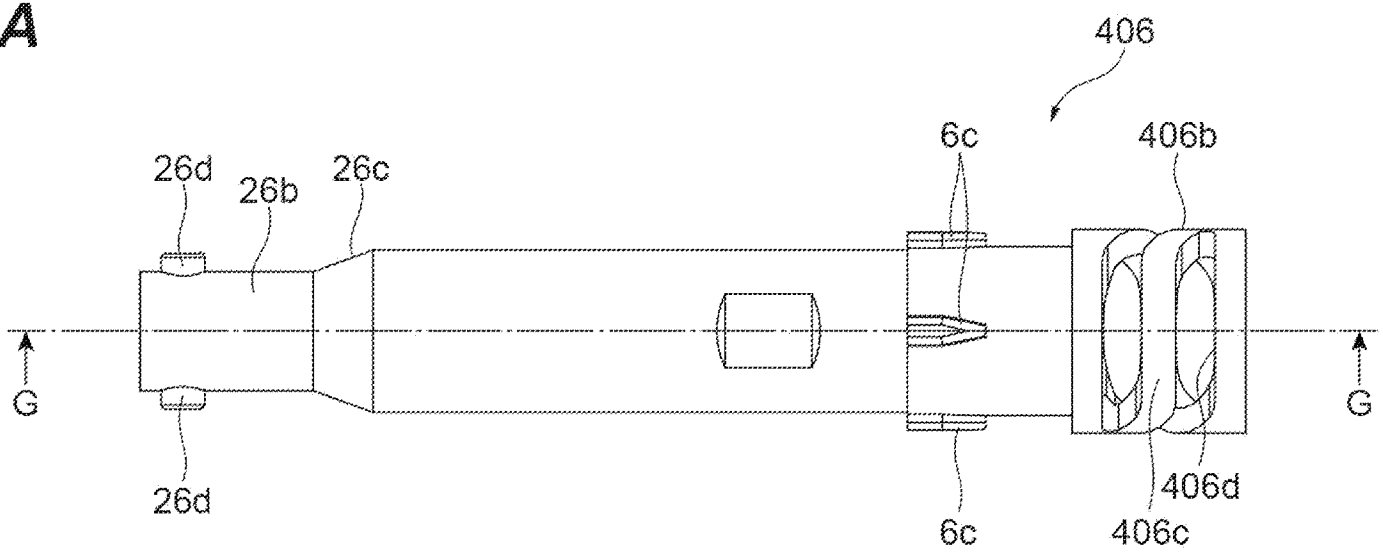
FIG. 23A is a side view illustrating a rotation stopper member of the cosmetic material feeding container of FIG. 22.
Figure 23B:
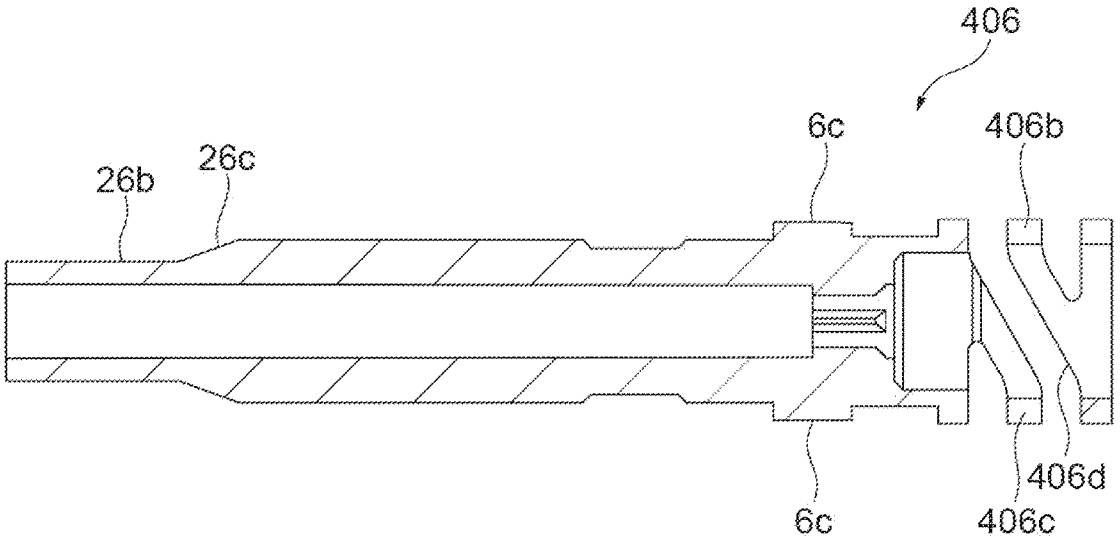
FIG. 23B is a cross-sectional view of the rotation stopper member illustrated in FIG. 23A, taken along line G-G.

FIG. 22 is a cross-sectional view illustrating an internal structure of a cosmetic material feeding container 400 according to yet another example. FIG. 23A is a side view illustrating a rotation stopper member 406 of the cosmetic material feeding container 400. FIG. 23B is a cross-sectional view taken along line G-G in FIG. 23A. As illustrated in FIGS. 22, 23A, and 23B, the example cosmetic material feeding container 400 is different from the example cosmetic material feeding container 300 in that the cosmetic material feeding container 400 does not include the second spring member 310, and in that the cosmetic material feeding container 400 includes a rotation stopper member 406 having a shape different from that of the rotation stopper member 26.

The rotation stopper member 406 includes a spring portion 406*b* facing the female screw member 8. For example, configurations of the rotation stopper member 406 other than the spring portion 406*b* may be the same as or similar to configurations of the above-described rotation stopper member 26 (or the rotation stopper member 216). The spring portion 406*b* is located in the rear end of the rotation stopper member 406, and contacts the front end of the female screw member 8.

For example, the spring portion 406*b* may be a resin spring portion that can expand and contract along the axial direction. According to examples, the spring portion 406*b* may be formed by a main body portion 406*c* extending spirally and a slit 406*d* communicating with the inside and outside of the main body portion 406*c* and extending in a spiral shape. In this way, the spring portion 406*b* expands and contracts along the axial direction by having the main body portion 406*c* and the slit 406*d* which have a spiral shape.

As described above, the example cosmetic material feeding container 400 is provided with the rotation stopper member 406 having the spring portion 406*b*. In this manner, the rotation stopper member 406 is biased against the tube 24 (or the tube 214) side (front side) by the spring portion 406*b*. Therefore, the projection 26*d* (or the projection 216*d*) can be smoothly guided to the second extending portion 24*j* (or the second extending portion 214*j*) of the tube 24. Furthermore, the example cosmetic material feeding container 400 does not require a component corresponding to the second spring member 310. Accordingly, the number of components may be reduced.

Figure 24:
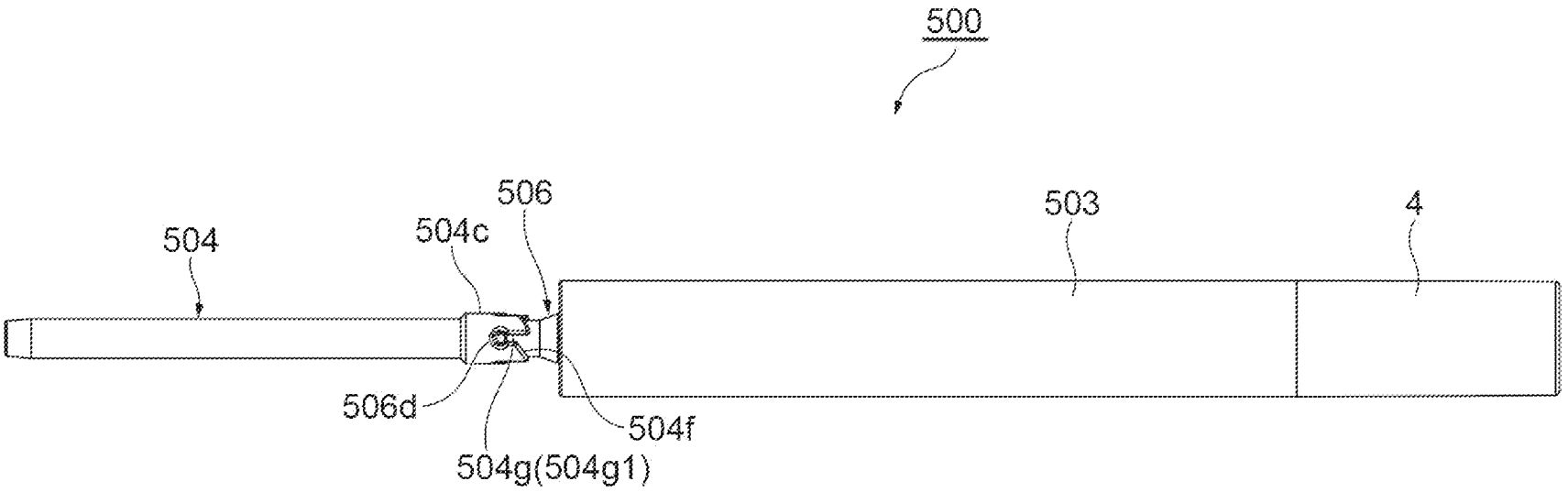
FIG. 24 is a side view illustrating a tube and a rotation stopper member of a cosmetic material feeding container according to yet another example.
Figure 25A:
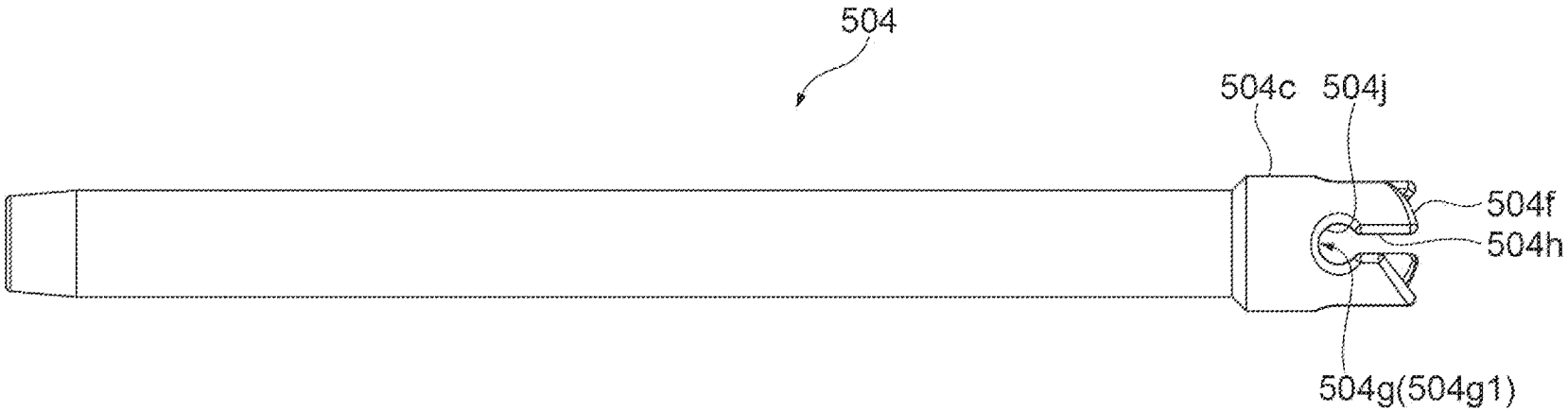
FIG. 25A is a side view illustrating the tube of FIG. 24.
Figure 25B:
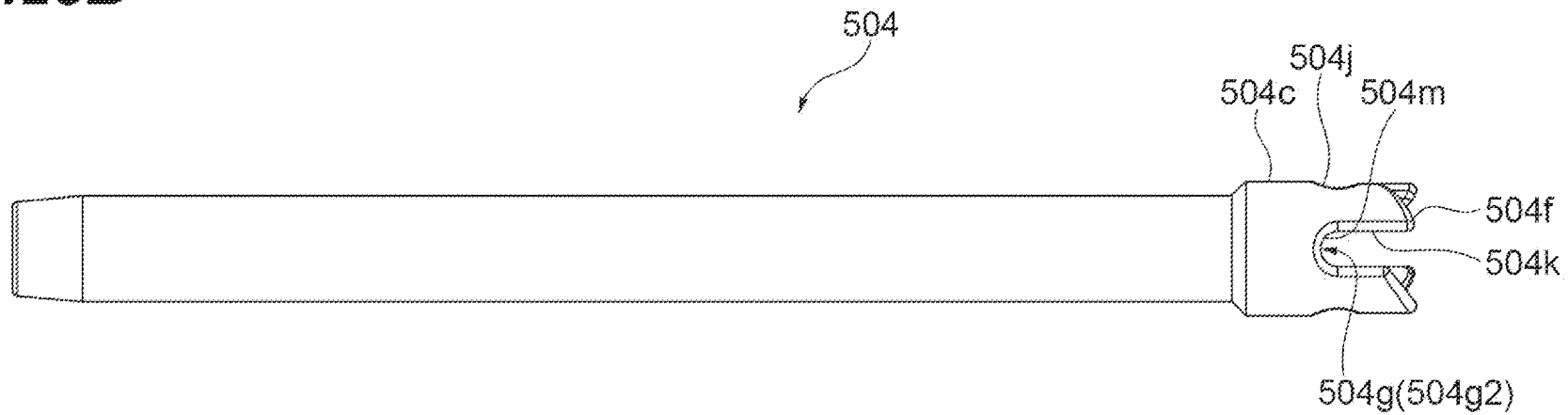
FIG. 25B is a side view illustrating the tube when viewed in a direction different from that in FIG. 25A.
Figure 26A:
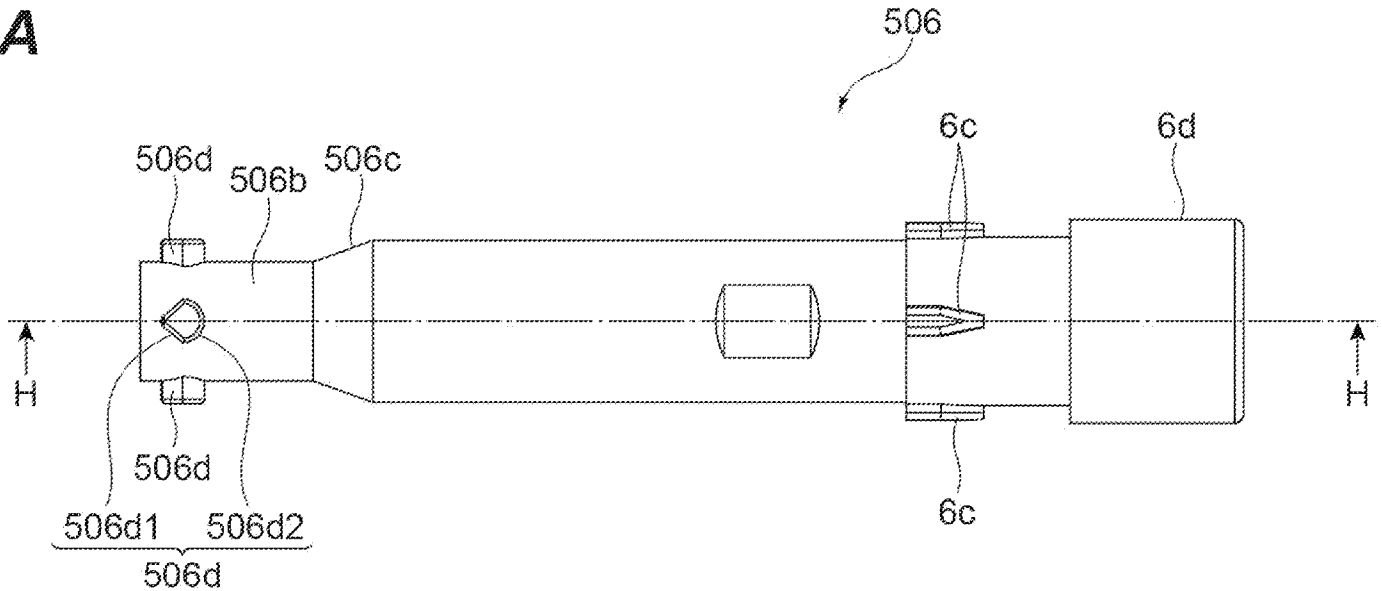
FIG. 26A is a side view illustrating the rotation stopper member of FIG. 24.
Figure 26B:
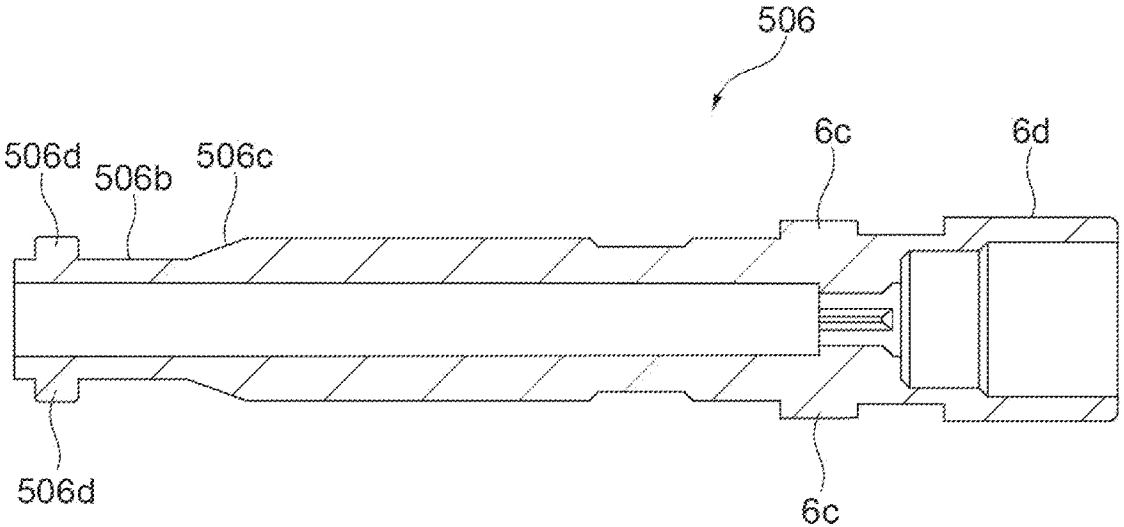
FIG. 26B is a cross-sectional view of the rotation stopper member illustrated in FIG. 26A, taken along line H-H.

A cosmetic material feeding container 500 according to yet another example will be described. FIG. 24 is a side view illustrating a container body 503, a tube 504, and a rotation stopper member 506 of the example cosmetic material feeding container 500. FIG. 25A is a side view illustrating the tube 504. FIG. 25B is a side view when the tube 504 is viewed in a direction different from that of FIG. 25A. FIG. 26A is a side view illustrating the rotation stopper member 506. FIG. 26B is a cross-sectional view taken along line H-H of the rotation stopper member 506.

The tube 504 has an enlarged diameter portion 504*c*. In addition, the tube 504 has an end surface 504*f* facing the rotation stopper member 506 side, and a locking portion 504*g* formed on the end surface 504*f* and by which the rotation stopper member 506 is caught. Similarly to the end surface 214*f* of the previously described example with reference to FIGS. 19, 20A and 20B, the end surface 504*f* of the tube 504 is inclined with respect to a plane orthogonal to the axial direction.

According to examples, the locking portion 504*g* includes a first locking portion 504*g*1 and a second locking portion 504*g*2 having a shape different from that of the first locking portion 504*g*1. According to examples, the tube 504 has two first locking portions 504*g*1 and two second locking portions 504*g*2. According to examples, the first locking portion 504*g*1 and the second locking portion 504*g*2 are alternately disposed along the circumferential direction of the tube 504. Each of the first locking portions 504*g*1 and the second locking portions 504*g*2 forms a recessed portion where the projection 506*d* of the rotation stopper member 506 may be inserted.

The first locking portion 504*g*1 has a first extending portion 504*h* extending forwardly from the end surface 504*f* and an expansion portion 504*j* expanding in an end portion on a side opposite to the end surface 504*f* in the first extending portion 504*h*. In some examples, the first extending portion 504*h* extends parallel to the axial direction and the expansion portion 504*j* expands in an arc shape from a front end of the first extending portion 504*h*.

The second locking portion 504*g*2 has a second extending portion 504*k* extending forwardly from the end surface 504*f* and a curved portion 504*m* located in an end portion on a side opposite to the end surface 504*f* in the second extending portion 504*k*. According to examples, the second extending portion 504*k* extends parallel to the axial direction, and the curved portion 504*m* is curved in an arc shape from a front end of the second extending portion 504*k*. A width of the second extending portion 504*k* is wider than a width of the first extending portion 504*h*.

As in the above-described configuration, the rotation stopper member 506 has a tapered surface 506*c* and an outer peripheral surface 506*b* located on the front side of the tapered surface 506*c*. Four projections 506*d* are formed on the outer peripheral surface 506*b*. In some examples, a top surface of the projection 506*d* has a mountain portion 506*d*1 spreading rearwardly from the front end, and a curved portion 506*d*2 curved in an arc shape to bulge in a rear end of the mountain portion 506*d*1.

Two of the four projections 506*d* are inserted in the first locking portion 504*g*1 of the tube 504, and the remaining two of the four projections 506*d* are inserted into the second locking portion 504*g*2 of the tube 504. The width of the second extending portion 504*k* is wider than the width of the first extending portion 504*h*. Accordingly, the projection 506*d* may be smoothly inserted into the second locking portion 504*g*2. In contrast, the projection 506*d* entering the first locking portion 504*g*1 may be moved toward the expansion portion 504*j* by pushing and spreading the first extending portion 504*h*. Then, the projection 506*d* reaching the expansion portion 504*j* is caught by the first extending portion 504*h*. Accordingly, the projection 506*d* can be firmly attached to the first locking portion 504*g*1.

As described above, in the example cosmetic material feeding container 500, similarly to the example cosmetic material feeding container 210 previously described, the end surface 504*f* of the tube 504 is inclined with respect to the plane orthogonal to the axial direction. Therefore, the projection 506*d* can smoothly engage with the locking portion 504*g* along the end surface 504*f*. In addition, the projection 506*d* is locked in a state of being caught by the first locking portion 504*g*1 (first extending portion 504*h*). Accordingly, the tube 504 may be more reliably prevented from falling off from the rotation stopper member 506.

Figure 27:
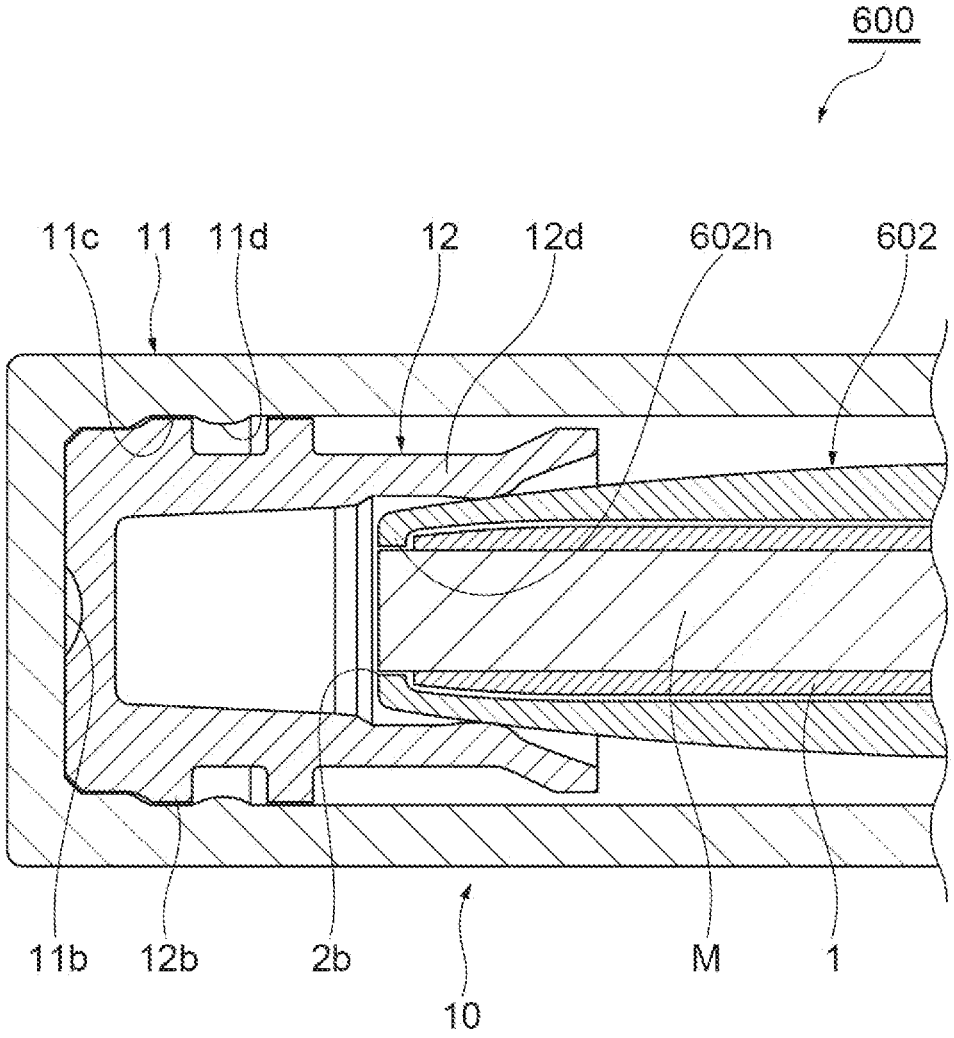
FIG. 27 is a cross-sectional view illustrating an internal structure of a cosmetic material feeding container according to yet another example.

A cosmetic material feeding container 600 according to yet another example will be described with reference to FIG. 27. As illustrated in FIG. 27, the example cosmetic material feeding container 600 includes a leading cylinder 602 different from the above-described leading cylinder 2. A tip of the leading cylinder 602 has a step portion 602*h* protruding inwardly in the radial direction. According to examples, the length of the step portion 602*h* in the axial direction may be shorter than the length of the above-described step portion 2*h* (cf. FIG. 4A or FIG. 4B) in the axial direction. As an example, the length of the step portion 602*h* in the axial direction may be approximately the same as the thickness in the radial direction of the leading cylinder 602 of a portion located in a base of the step portion 602*h*.

As described above, in the example cosmetic material feeding container 600, the length in the axial direction of the step portion 602*h* protruding inwardly in the radial direction of the leading cylinder 602 in the tip of the leading cylinder 602 is approximately the same as the thickness of the tip portion of the leading cylinder 602. Therefore, a contact region between the step portion 602*h* and the cosmetic material M can be reduced by shortening the length of the step portion 602*h* of the leading cylinder 602 in the axial direction. Accordingly, a breakage of the cosmetic material M in the contact region may be prevented or inhibited.

Figure 28:
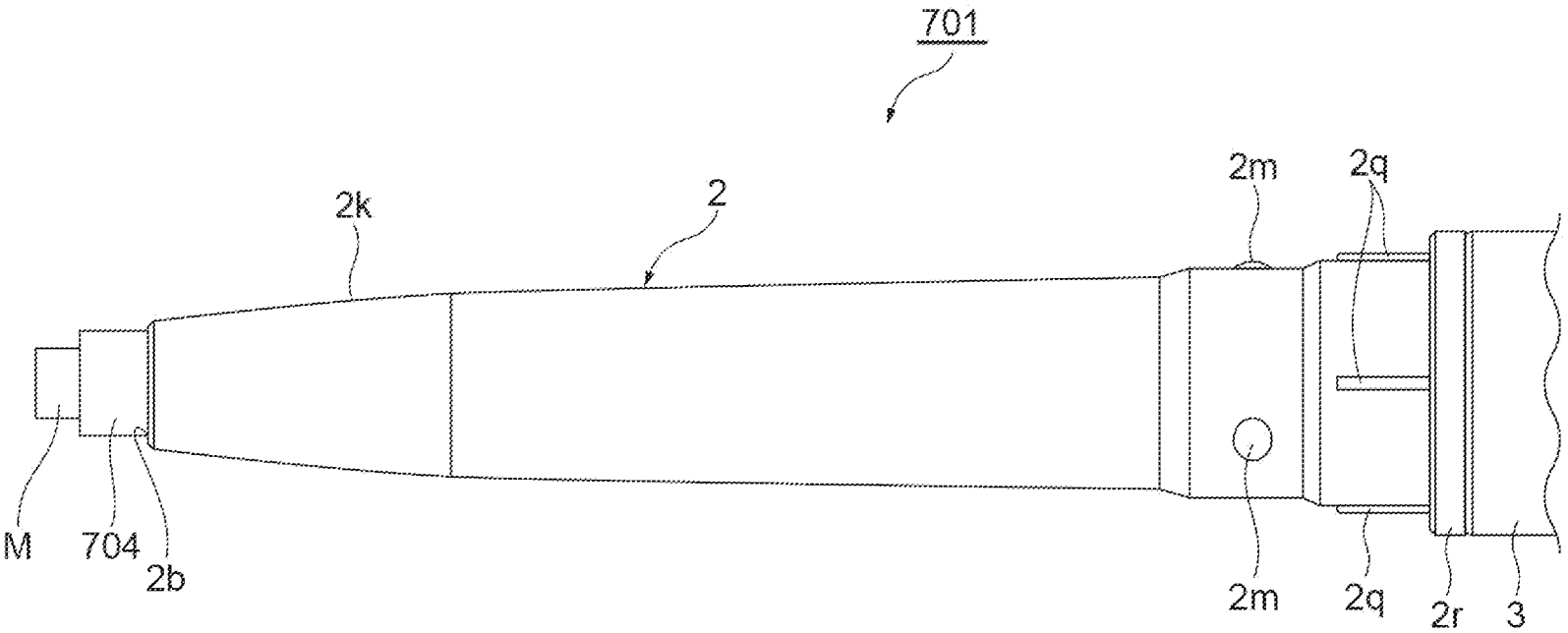
FIG. 28 is a side view illustrating a cosmetic material feeding container according to still another example.

Next, a cosmetic material feeding container 701 according to still another example will be described with reference to FIG. 28. As illustrated in FIG. 28, in the cosmetic material feeding container 701, a tube 704 has a different position with respect to the leading cylinder 2 as from in the previously described examples. The tube 704 is fixed in a state of protruding from the opening 2*b* of the leading cylinder 2.

As described above, in the example cosmetic material feeding container 701, the tube 704 filled with the cosmetic material M, is fixed inside the leading cylinder 2 in a state of protruding from the opening 2*b* of the leading cylinder 2. Therefore, the cosmetic material M does not contact the leading cylinder 2 when the cosmetic material M is fed. Accordingly, a breakage of the cosmetic material M due to the contact with the leading cylinder 2 may be prevented.

Hitherto, the cosmetic material feeding containers according to various embodiments have been described. However, the cosmetic material feeding container according to the present disclosure can be further modified. For example, although the example cosmetic material feeding container 100 including the ratchet member 7 configured to feed the cosmetic material in by operating a rotational coupling in one rotational direction only, has been described, the cosmetic material feeding container may be adapted to feed the cosmetic material by operating the rotational coupling in two rotational directions (e.g., both the first direction and the second direction opposite to the first direction). In this case, the ratchet member 7 can be omitted, and the number of components can be reduced to simplify the configuration. In addition, although the example cosmetic material feeding container 100 in which only the tube 1 can be replaced has been described, the replaceable component is not limited to the tube 1, and the configuration can be suitably modified. For example, other components may be replaceable together with the tube 1.

In addition, although the example cosmetic material feeding container 100 in which the cosmetic material M is moved forwardly by the relative rotation of the container body 3 and the tail plug 4 has been described, the cosmetic material feeding container may be configured so that the cosmetic material moves forwardly by the relative rotation of the leading cylinder and the container body. The configuration of the feeding mechanism that feeds the cosmetic material can be suitably modified. Additionally, the cosmetic material feeding container may include a knock-type extrusion mechanism instead of the feeding mechanism that feeds the cosmetic material.

In addition, in the cosmetic material feeding container 100, when the leading cylinder 2 is detached from the container body 3 and the tube 1 is detached from the pusher bar 5, the rotation stopper member 6 and the pusher bar 5 rotate, and the pusher bar 5 moves rearwardly due to the biasing force of the spring member 9. In other examples, the cosmetic material feeding container may be configured so that the pusher bar is manually moved rearwardly (for example, by a relative rotation) instead of the biasing force of the spring member.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

What is claimed is:

1. A cosmetic material feeding container comprising:

a cylindrical tube that accommodates a cosmetic material;

a leading cylinder that removably accommodates the tube therein, wherein the leading cylinder forms an opening to expose the cosmetic material;

a container body that is detachably coupled with the leading cylinder, in order to replace the tube when the leading cylinder is detached from the container body;

a cylindrical female screw member that is located inside the container body and rotationally fixed with the container body, wherein the female screw member forms a female screw thread;

a pusher bar including a male screw thread engaging the female screw thread of the female screw member, wherein the pusher bar is configured to push the cosmetic material accommodated in the tube to an outside of the tube; and a rotation stopper member that is configured to rotationally fix the pusher bar relative to the leading cylinder in a circumferential direction.

2. The cosmetic material feeding container according to claim 1, wherein the rotation stopper member has a projection on an outer peripheral surface, and wherein the tube has a groove to insert therein the projection of the rotation stopper member, from an end portion of the tube.

3. The cosmetic material feeding container according to claim 1, wherein the pusher bar is configured to move in an axial direction toward the opening of the leading cylinder, when the container body is rotated in a first direction relative to the female screw member, wherein the female screw member includes a first ratchet tooth, wherein the cosmetic material feeding container includes a ratchet member provided inside the container body, to restrict the rotation of the container body in a second direction opposite to the first direction, relative to the female screw member, and wherein the ratchet member has a second ratchet tooth that engages with the first ratchet tooth of the female screw member.

4. The cosmetic material feeding container according to claim 3, wherein the rotation stopper member has a substantially cylindrical shape and is rotationally fixed with the ratchet member when the leading cylinder is coupled with the container body, and wherein when the leading cylinder is detached from the container body, the rotation stopper member is movable in the axial direction to disengage from the ratchet member, so as to be rotatable in the circumferential direction with respect to the ratchet member.

5. The cosmetic material feeding container according to claim 1, wherein the container body has an open end opposite the leading cylinder, and wherein the cosmetic material feeding container further comprises a tail plug to seal the open end of the container body.

6. The cosmetic material feeding container according to claim 1, wherein the pusher bar has a front end that is coupled to the tube, and a rear end opposite the front end in an axial direction, wherein the tube is detachable from the pusher bar to be replaced with a new tube, and wherein cosmetic material feeding container further comprises a spring member to bias the pusher bar toward the rear end, when the tube is detached from the pusher bar.

* * * * *